US005553859A

United States Patent [19]

Kelly et al.

[11] Patent Number: 5,553,859

[45] Date of Patent: Sep. 10, 1996

[54] ARCADE GAME FOR SENSING AND VALIDATING OBJECTS

[75] Inventors: Bryan M. Kelly, Almo; Matthew F. Kelly, San Ramon; John G. Kroeckel, San Leandro; Joseph J. Haas, Pleasanton; Jayash J. Lad, San Jose, all of Calif.

[73] Assignee: Lazer-Tron Corporation, Pleasanton, Calif.

[21] Appl. No.: 408,618

[22] Filed: Mar. 22, 1995

[51] Int. Cl.[6] ..... A63B 67/06

[52] U.S. Cl. ..... 273/338; 273/371

[58] Field of Search ..... 273/336, 338, 273/371

[56] References Cited

U.S. PATENT DOCUMENTS 5,292,127 3/1994 Kelly et al. ..... 273/138 R

*Primary Examiner*—William H. Grieb

*Attorney, Agent, or Firm*—Hickman Beyer & Weaver

[57] ABSTRACT

An arcade game including an object sensor for detecting a playing piece directed by a player. A target field receives the directed playing piece, and the sensor determines the identity and a final position of the playing piece at rest. A scoring mechanism provides a game score based on the identity and final resting position of the playing piece. Preferably, the playing piece, such as a ring or coin, engages one of multiple individual targets, such as bottles or receptacles. A return mechanism provides the playing piece to the player, and an award dispenser dispenses an award to a player based on the game score. The sensor includes a visual sensor and digital processor for validating and determining a final position of the moving playing piece by detecting visible light. The digital processor examines an image of the target field to determine and validate the identity of the playing piece, the trajectory of the playing piece, and the final position of the playing piece to determine the game score. The sensor and digital processor compensate for changing lighting conditions during game play.

89 Claims, 14 Drawing Sheets

150
184
TURNTABLE MOTOR
134
DISPENSER SOLENOID
72
COMB LIFT MOTOR
186
VISION BOARD
182
AWARD MOTOR
151
30
PLAYER SENSOR
DRIVERS
187
SERIAL INTER-FACE
154
RAM
162
84a, 84b
COMB LIFT SENSORS
μP
152
ROM
156
23
END GAME BUTTON
164
BUFFERS
190
LATCH
178
TEST SWITCH
176
170
OKI SOUND CHIP
180
COIN SWITCH
158
LATCH
126
RING SENSOR
172
L.P.F.
160
SWITCHES
174
AUDIO AMP
166
LATCHES
192
LATCH
SPEAKER
168
LAMP DRIVERS
28
188
066
34

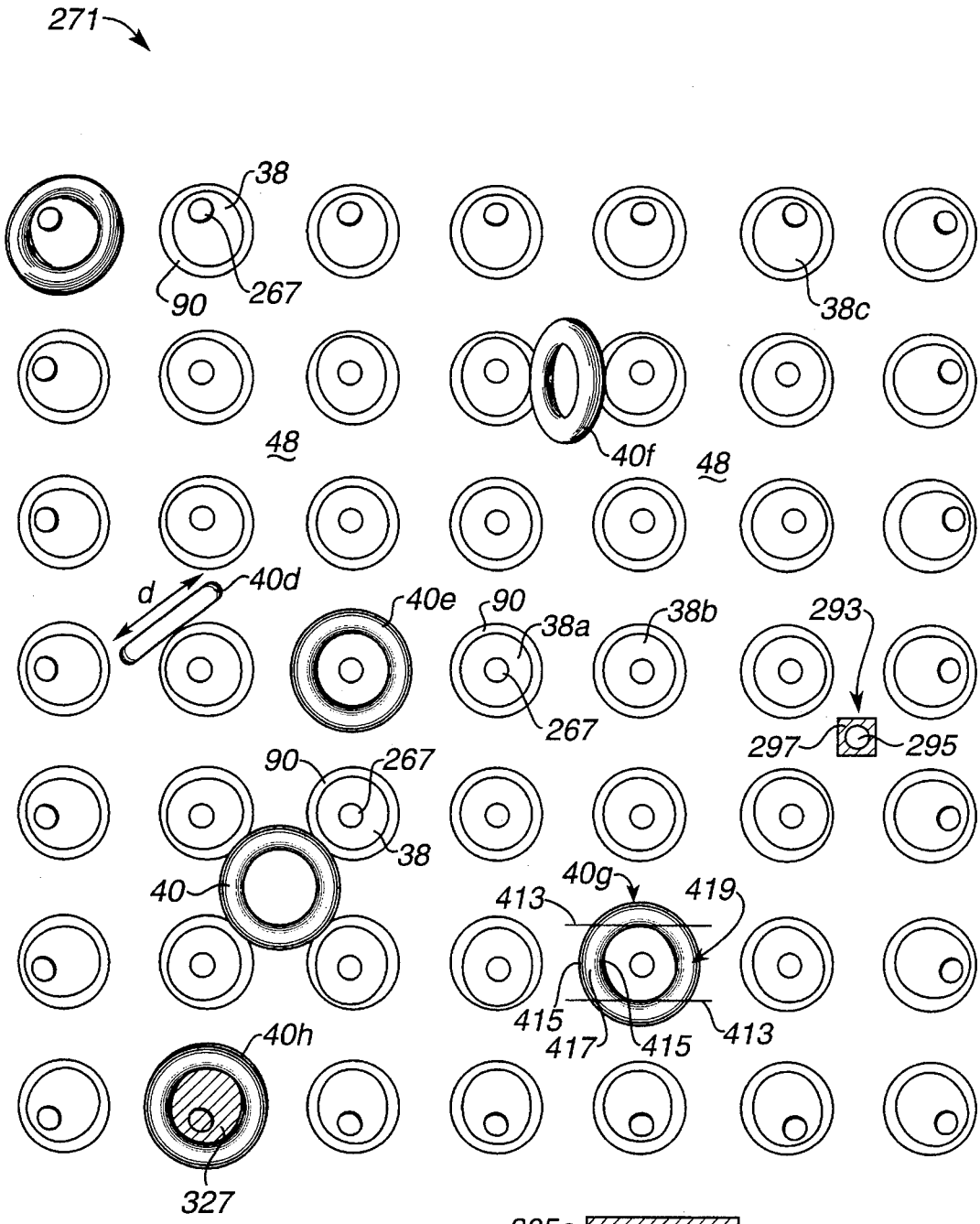
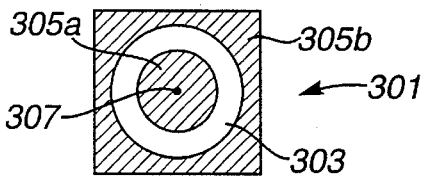
Figure 11

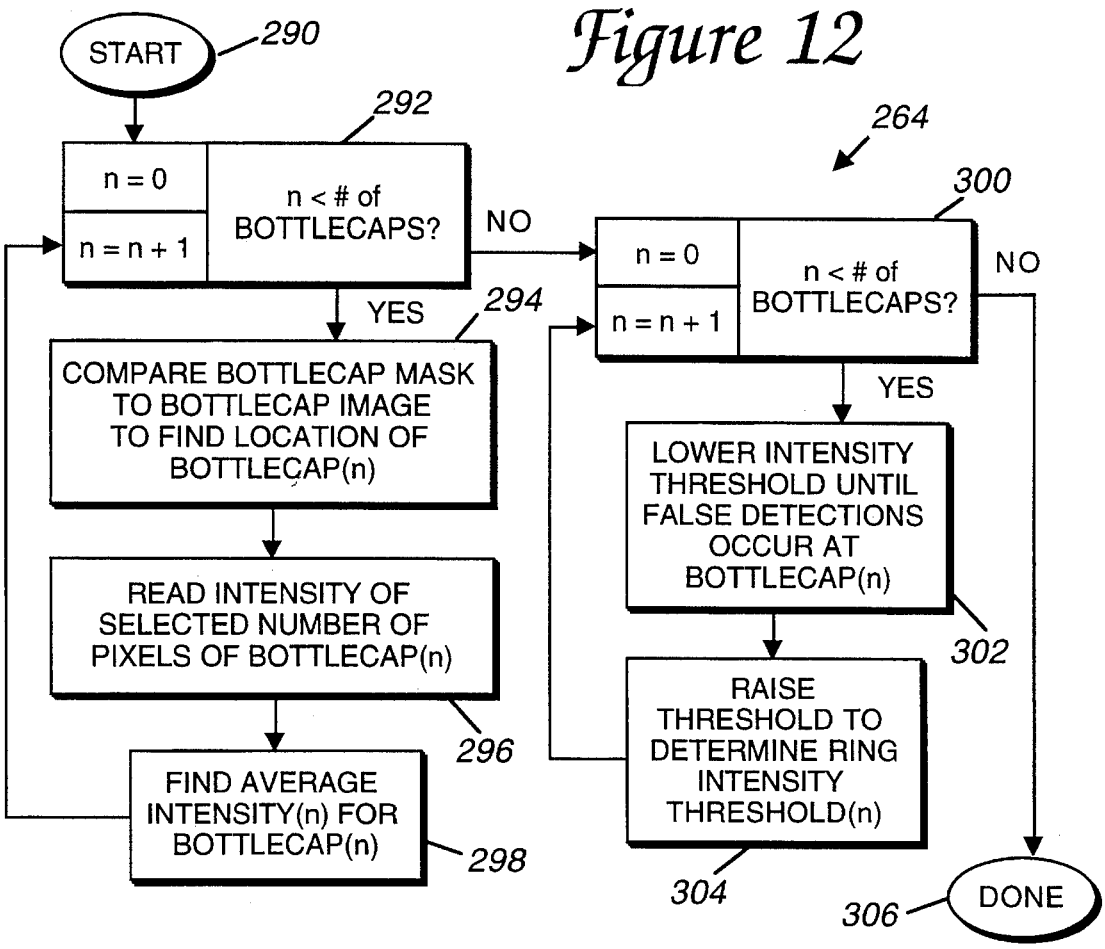
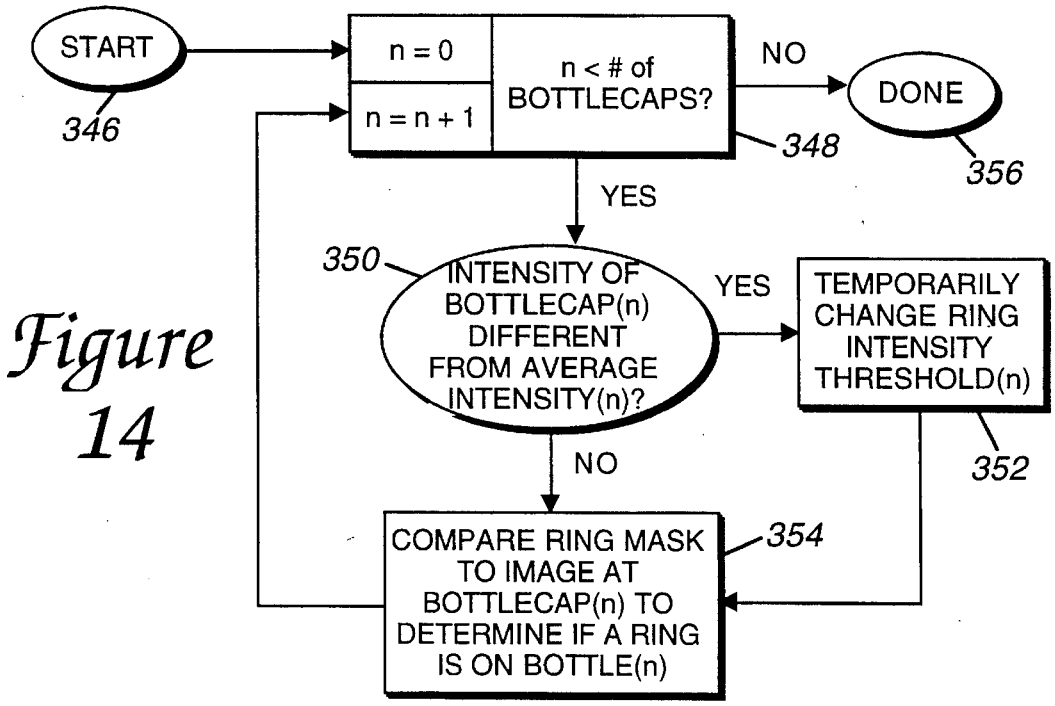
Figure 14

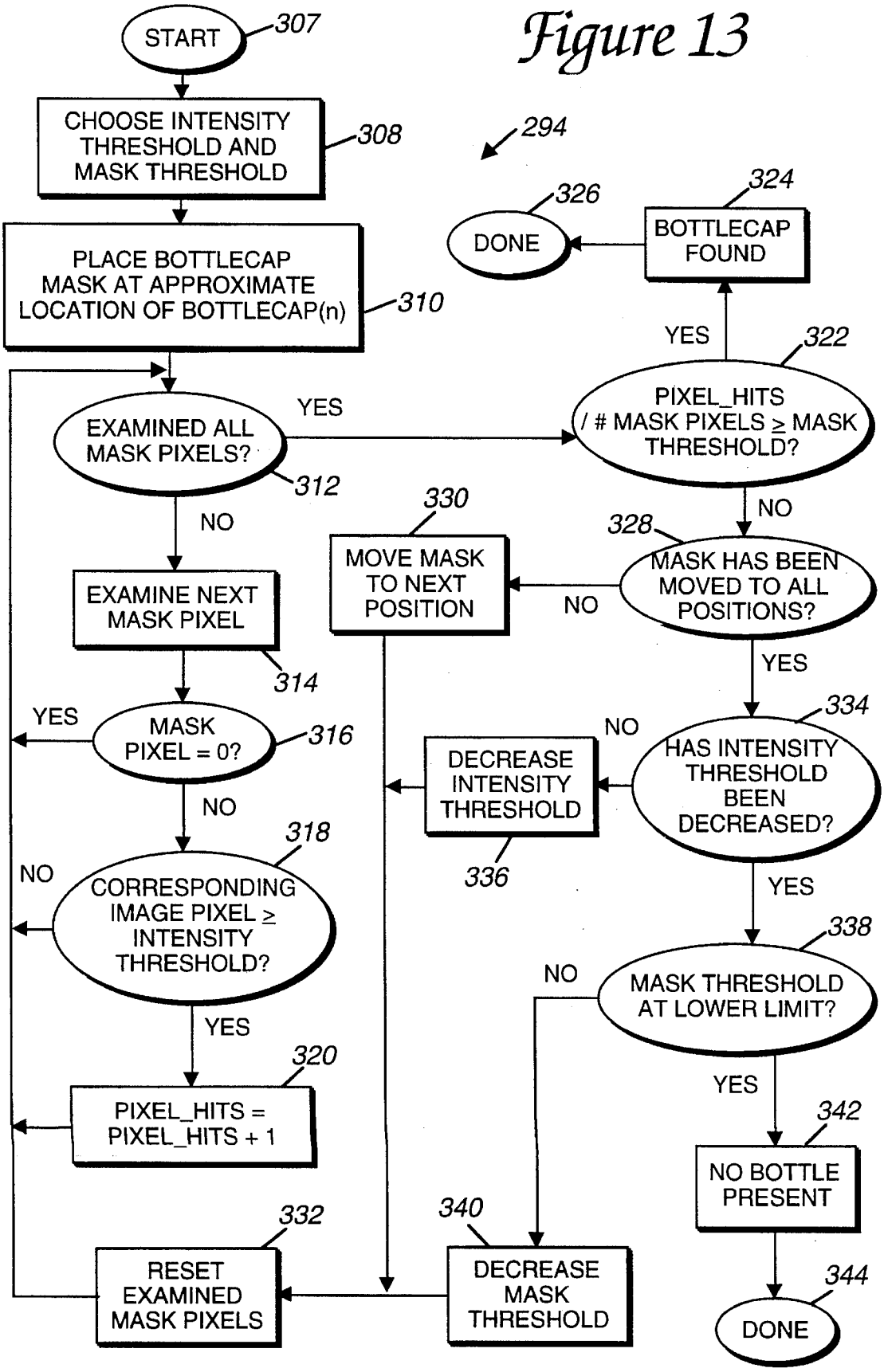
Figure 13
294
START
307
CHOOSE INTENSITY THRESHOLD AND MASK THRESHOLD
308
PLACE BOTTLECAP MASK AT APPROXIMATE LOCATION OF BOTTLECAP(n)
310
EXAMINED ALL MASK PIXELS?
312
YES
NO
EXAMINE NEXT MASK PIXEL
314
MASK PIXEL = 0?
316
YES
NO
CORRESPONDING IMAGE PIXEL ≥ INTENSITY THRESHOLD?
318
NO
YES
PIXEL_HITS = PIXEL_HITS + 1
320
RESET EXAMINED MASK PIXELS
332
PIXEL_HITS / # MASK PIXELS ≥ MASK THRESHOLD?
322
YES
NO
BOTTLECAP FOUND
324
DONE
326
MASK HAS BEEN MOVED TO ALL POSITIONS?
328
NO
YES
MOVE MASK TO NEXT POSITION
330
HAS INTENSITY THRESHOLD BEEN DECREASED?
334
NO
YES
DECREASE INTENSITY THRESHOLD
336
MASK THRESHOLD AT LOWER LIMIT?
338
NO
YES
DECREASE MASK THRESHOLD
340
NO BOTTLE PRESENT
342
DONE
344

ARCADE GAME FOR SENSING AND VALIDATING OBJECTS

BACKGROUND OF THE INVENTION

1. Field of the Invention

This invention relates to games normally played in an arcade environment, and more particularly to such games played by detecting the trajectory, position and identity of propelled objects with reference to designated targets.

2. Background of the Related Art

Games of many types are played in arcade environments. One type of game includes objects sensors for detecting objects thrown by players at provided targets.

An example of a game with an object sensor is found in U.S. Pat. No. 4,130,281, of Leber et al., which describes a horseshoe-pitching game having a receiver assembly with a pit and stake for receiving a pitched horseshoe. A TV camera and computer are used to determine the final position of a horseshoe and the resulting score.

Another example is found in U.S. Pat. No. 4,789,163, of Warner et al., which describes an indoor horseshoe-pitching game in which a stake is positioned in a receiving apparatus. A sensor grid determines the position of a thrown horseshoe and a score is displayed.

Yet another example is found in U.S. Pat. No. 4,545,576, of T. Harris., which describes an apparatus and method for computing the trajectory of a moving object. Video cameras and a computer identify a ball and compute its position in three dimensions as a function of time.

The object sensing games of the prior art, while enjoyable, are limited when determining the combination of a trajectory of a thrown object and the final resting position of the known object. These prior art games tend to determine one or the other of these characteristics, but not both. In addition, the prior art games tend to assume that the thrown object is a valid object and do not therefore determine the identity of an object or perform other validation procedures. Furthermore, the prior art games tend to require a great amount of operator supervision to prevent player abuses of the game and to compensate for changing environmental conditions. These limitations can be undesirable in an arcade environment for a game which identifies a thrown object and presents a score to a player based on the trajectory and the final position of the object.

SUMMARY OF INVENTION

The present invention provides an arcade game having an object sensor. The arcade game provides improved object detection and validation methods that reliably detect a directed playing piece and provide a score based on the final position, trajecotry, and/or identity of the playing piece.

More particularly, a game apparatus of the present invention includes a sensor for detecting a playing piece directed by a player. A target field receives the directed playing piece, and the sensor determines the identity and a final position of the playing piece at rest after the playing piece engages the target field. A scoring mechanism provides a game score based on the identity and final resting position of the playing piece.

The target preferably includes a target field including a plurality of individual targets, and the scoring mechanism provides a game score when the playing piece engages an individual target. In a preferred embodiment, the individual targets are cylindrical objects extending perpendicularly from the playing field, such as bottles, and the playing piece is a ring. The game score is increased when the ring has a final position such that one of the cylindrical objects extends through the center of the ring. In another embodiment, the playing pieces are coins, and the targets are receptacles or target ring indicia. A return mechanism provides the playing piece to the player after the playing piece has been directed by the player to the target. The return mechanism includes a mechanism for moving the target such that the playing piece moves into a playing piece collector. Preferably, this includes a mechanism for tilting the target field such that the playing piece moves off the target field into the playing piece collector. The playing piece collector mechanism preferably includes a turntable for moving a playing piece to a playing piece dispenser. The playing piece dispenser provides the playing piece to the player. An award dispenser dispenses an award to a player based on the game score. The game apparatus is preferably controlled by a digital computer.

The sensor includes a visual sensor for validating and determining a final position of the moving playing piece by detecting visible light. The sensor preferably includes a video camera and charge coupled device for detecting and recording an image of the moving playing piece and for recording an image of the target field and the final position of the playing piece. The sensor also includes a digital processor for analyzing the image, determining the final position of the playing piece, and relaying the final position to the scoring mechanism.

When detecting the final resting position of a playing piece, the digital processor compares a portion of the image of the target field to a predetermined image, such as a mask pixel map, to determine the identity of the playing piece and the final position of the playing piece. The target field preferably has a plurality of individual targets, such as bottles. The image of each individual target is examined to accurately locate the target and to determine ambient lighting conditions before a game begins. When a game begins, images are taken and analyzed to determine if a playing piece has engaged a target. If the image of a target corresponds to the predetermined image within a threshold percentage, then a playing piece has engaged that target and is in a scoring position. The digital processor also preferably examines the image of the target for pixels having at least a threshold intensity to detect a playing piece. An image enhancing process can be utilized to provide the recorded image in a higher resolution. If the intensity of the targets change during the course of a game, the digital processor compensates for these changes.

The digital processor and the sensor can preferably analyze the identity of a moving object as the object is moving toward or over the target field to determine if the object is a valid playing piece for the game apparatus. A moving object is preferably recorded in an image and the identity of the object in the image is measured and verified. The digital processor and the sensor can also analyze the trajectory of a moving object to determine if the object is a valid playing piece for the game apparatus. Multiple images of the target field are recorded and examined to determine a trajectory of the playing piece. The trajectory is compared to a predetermined valid trajectory. The scoring mechanism provides the game score for the playing piece only when the identity and trajectory of the object is valid for a playing piece.

An advantage of the present invention is that the object sensing apparatus of the present invention is accurate and dependable for validating thrown objects as playing pieces or non-playing pieces. In addition, the sensor of the game apparatus can compensate for changing lighting conditions and other environmental conditions that can occur. The game can thus be operated with minimal operator supervision or maintenance.

Another advantage of the present invention is that the identity, trajectory, and final position of directed playing pieces are reliably determined to provide an accurate score to a player of the game apparatus.

These and other advantages of the present invention will become apparent to those skilled in the art after reading the following descriptions and studying the various figures of the drawings.

BRIEF DESCRIPTION OF THE DRAWINGS

FIG. 11 is a diagrammatic illustration of an image of the target field recorded by the sensing apparatus;

FIG. 12 is a flow diagram illustrating the step of FIG. 10 of calibrating and locating targets on the target field;

FIG. 13 is a flow diagram illustrating the steps of FIG. 12 of comparing a target mask to a portion of the recorded image to locate targets;

FIG. 14 is a flow diagram illustrating the step of FIG. 10 of analyzing the recorded image;

DETAILED DESCRIPTION OF THE PREFERRED EMBODIMENTS

Figure 1:
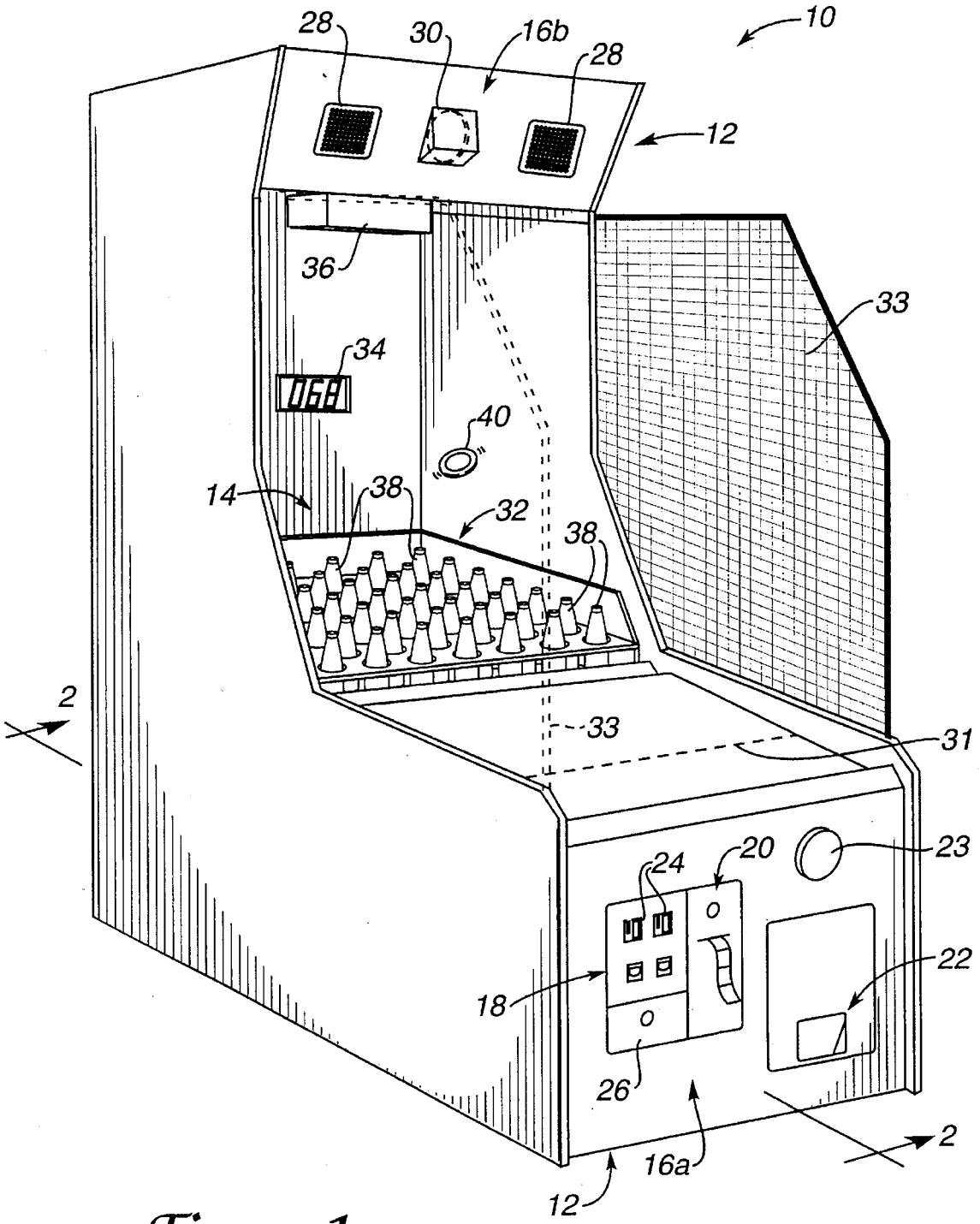
FIG. 1 is a perspective view of a game apparatus of the present invention.

FIG. 1 is a perspective view of a preferred embodiment of a game apparatus 10 in accordance with the present invention. Game apparatus 10 includes front panel sections 12 and a target section 14.

Front panel section 12 includes two panels 16*a* and 16*b*. Front panel 16*a* is positioned to be accessible to a player of game apparatus 10 and includes a coin deposit panel 18, an award dispenser 20, a playing piece dispenser 22, and an end game button 23.

Coin deposit panel 18 includes one or more coin deposit slots 24 and a cash box panel 26. Coin deposit slot 24 preferably accepts standard currency coins or game tokens that are often available in an arcade environment. A game begins after a coin or token has been inserted by the player. Preferably, playing pieces are dispensed from dispenser 22 to begin a game, as described subsequently. Cash box panel 26 allows an operator of game apparatus 10 to access coins or other tokens that have been deposited by a player and have been stored in a cash box positioned behind front panel 16*a*. Such coin boxes are well known in the art.

Award dispenser 20 preferably dispenses a ticket award to the player based upon the result of a game in progress. In this present embodiment, tickets may be accumulated by a player and redeemed to win various prizes. Ticket dispensing mechanisms are well-known in the prior art. Other types of awards besides tickets may be dispensed by award dispenser 20. For example, sports cards or other trading cards, toy prizes, or even coins or currency can be dispensed. The awards are preferably stored in a storage area behind the front panel 16*a*.

Playing piece dispenser 22 is positioned on and behind front panel 16*a* and provides playing pieces to a player of game apparatus 10 to be used in a game. In the described embodiment, the playing pieces are rings 40 to be tossed into target section 14. In other embodiments, the playing pieces can be coins, balls, or other types and shapes. Dispenser 22 is preferably an aperture in front panel 16 including a hinged door which is pushed open by a player to access the dispensed playing pieces. The playing piece return and dispensing process is described in greater detail with respect to FIG. 2. Preferably, the total number of playing pieces are dispensed at the beginning of a game (e.g., after a player has inserted a coin into coin deposit slot 24) and are held in dispenser 22 for the player. Dispenser preferably allows dispensed playing pieces to be removed by the player but prevents access to the interior of the dispensing chamber by a player inserting his hand in the dispensing aperture, etc.

End game button 23 is preferably located on front panel 16*a*. When a player pushes this button during a game, the game ends and an award is dispensed, if applicable. Button 23 allows an award to be dispensed to a player immediately when the player has thrown all dispensed rings, i.e., the player does not have to wait for a time limit to expire for the game to end and to receive an award. Other controls (not shown), such as buttons, switches, etc., can also be added to front panel 16*a* and selected by a player of the game to make various other selections concerning game play. For example, a player could select a one- or two-player game, a preferred award type, a progressive option, etc.

Front panel 16*b* is preferably provided above target section 14 of game apparatus 10 and includes speakers 28 and player sensor 30. Speakers 28 emit sounds based on game actions and other game states and is controlled by the game unit controller system. The operation of the speakers will be discussed in greater detail subsequently.

Player sensor 30 is preferably a electromagnetic sensor, such as a thermal sensor for detecting the presence of a human body, which is well-known to those skilled in the art.

A hood or similar cover of sensor 30 preferably directs the sensing field of sensor 30 to the desired area of detection. Player sensor 30 detects heat preferably in an area from about six inches or a foot in front of front panel 16*a* to the target field 32. Sensor 30 is operative to detect if a player extends an arm or other part of the body within the sensed area. If a player is detected by sensor 30, the game is preferably over and the game score reset to zero. This prevents a player from trying to cheat at the game by extending an arm to place playing pieces over targets, etc. Preferably, a line 31 is marked on game apparatus 10 to inform the player how far he or she can extend an arm before activating sensor 30. Sensor 30 can also be preferably controlled to increase or decrease its detection area and to adjust its sensitivity. Other types of sensors, such as motion detectors, break beam sensors, etc., can be used in alternate embodiments.

In alternate embodiments, front panels 16*a* and 16*b* can be implemented as a single front panel positioned in a variety of locations on game apparatus 10, such as above target section 14, below or behind target section 14, etc.

Target section 14 includes target field 32, score display 34 and sensing apparatus 36. A playing piece return mechanism for returning thrown playing pieces is also preferably provided below target field 32, as described with reference to FIG. 2.

Target field 32 is an area that is provided as a target for playing pieces thrown or otherwise directed by a player of game apparatus 10. Side panels 33 are preferably provided to prevent playing pieces from being thrown from the side of the game apparatus and to prevent playing pieces from failing outside game apparatus 10. In the embodiment shown by FIG. 1, target field 32 includes a number of bottles 38 or similar upwardly-projecting targets. Playing pieces such as rings 40 or similar articles having a hollow, open center can be tossed by a player towards target field 32 in an attempt to land the playing piece over a bottle. Such games are well known to those skilled in the art of redemption or carnival games. In other embodiments, target field 14 can include other types of targets. For example, collection dishes or other containers can be provided as targets at which coins or other playing pieces are tossed. Or, playing pieces can be tossed at concentric target rings positioned in target field 32. Other embodiments of target field 32 are described in greater detail subsequently with respect to FIG. 17. In yet other embodiments, rings 40 or other playing pieces can be projected at target field 32 with a guide or other projecting apparatus rather than being thrown by a player.

Score display 34 is used to display current scores for a game to the player. The game score is based on playing pieces 40 that have engaged the targets in target field 32 and determines the size of the award received by the player from award dispenser 20. Game score is described with reference to FIG. 10. In addition, a progressive score display can be provided for displaying a progressive score. A progressive score, separate from the game score, can be accumulated and can be added to the game score if a progressive goal is achieved. For example, if a player manages to throw a predetermined number of rings, such as five, over bottles, then the player has achieved a progressive goal and the progressive score is added to the player's game score. The progressive score, for example, can be incremented with every coin inserted in coin slot 24, automatically incremented over time, etc. Multiple game apparatuses can also be linked together to contribute to a collective progressive score, which can be rewarded to the first player of a linked game apparatus to achieve a progressive goal. Progressive goals, scores, and bonus apparatuses are described in greater detail in U.S. Pat. No. 5,292,127, by Kelly et al., entitled "Arcade Game", which is hereby incorporated by reference herein. Additional score displays can be used to provide scores for multiple players of game apparatus 10 or provide other functions during game play. A number of awards, such as tickets, are preferably dispensed from award dispenser 20 based on the final game score displayed by display 34. In other embodiments, score display 34 can be positioned in other areas of game apparatus 10, such as on front panel 16*a* or 16*b*.

Sensing apparatus 36 is preferably positioned above target field 32 and senses any objects entering the target field. In the described embodiment, sensing apparatus 36 is a camera that continuously monitors target field 32 for any rings 40 or other playing pieces that are thrown by the player. Other types of sensors can be used in alternate embodiments. The sensing apparatus distinguishes the appropriate playing pieces used in the game and determines if any playing pieces have engaged targets such as bottles 38. The sensing apparatus 36 preferably also monitors the target field 32 even when no game is played, so that ambient light conditions can be sensed, calibrations performed, and objects thrown into target field 32 can be cleared. Sensing apparatus 36 is described in greater detail below with respect to FIGS. 9 and 10.

The game score display 34, sensing apparatus 36, coin detection, award dispensing, and other functions of the game apparatus are preferably controlled by a control system. This system is described in detail below with respect to FIG. 8.

Figure 2:
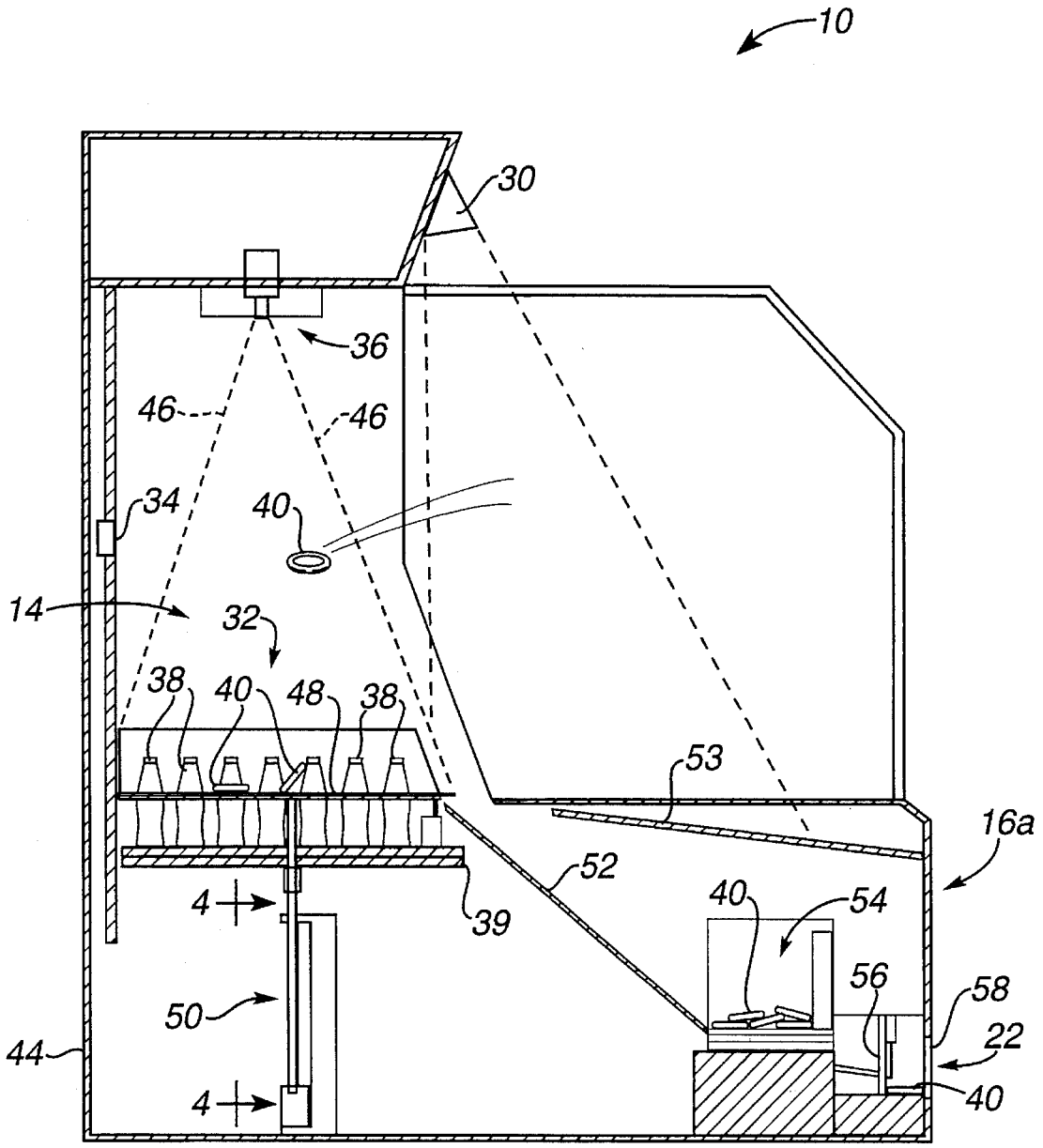
FIG. 2 is a side cross-sectional view taken along line 2—2 of FIG. 1.

FIG. 2 is a cross sectional side elevational view of game apparatus 10 taken along line 2—2 of FIG. 1. Game cabinet 44 supports the front panels 16*a* and 16*b* and target section 14. Playing pieces 40 are provided in playing piece dispenser 22 to be picked up by a player and tossed towards target section 14.

Sensing apparatus 36 continually scans the target field 32 during a game. Preferably, the area detectable by sensing apparatus 36 is approximately defined by dashed lines 46. When a ring 40 or other playing piece is thrown into the area between dashed lines 46, sensing apparatus 36 records the motion of the ring and the final resting place of the ring (if the resting place is within the area of dashed lines 46). The sensing apparatus can also distinguish if the playing piece is a correctly-sized ring for use in the game and if the ring has a valid trajectory, as described in greater detail with reference to FIG. 10. In alternate embodiments, sensing apparatus 36 can be angled to have a field of vision extending more toward the player of game apparatus 10 so that thrown playing pieces can be detected in flight before they reach target field 32 and, for example, sound, light, and other effects can be generated in response.

Bottles 38 are targets that rest on a base 39 that is coupled to the game cabinet 44. Bottles 38 are preferably secured to base 39 with, for example, glue or other fasteners. Rings 40 that fall onto target field 32 either come to rest over bottles 38 or are positioned between or to the side of bottles 38 on the surface of a comb 48. Once all of the rings that were dispensed to the player are sensed in target field 32, a period of time elapses since the player began the game, or the game otherwise ends, the rings 40 are returned to playing piece dispenser 22. This is accomplished by lifting comb 48 above bottles 38 so that the rings 40 can be moved (shown with respect to FIGS. 3, 5*a*, and 5*b*). A comb lifting mechanism 50 that is preferably positioned underneath comb 48 lifts and tilts the comb so that rings 40 can slide down the comb from the force of gravity. The comb 48 and comb lifting mechanism 50 are described in greater detail with reference to FIG. 4. A cover 53 is positioned above ramp 52 and other mechanisms to prevent a player from interfering with the playing piece return process.

After comb 48 is lifted and tilted, rings 40 slide off comb 48 onto ramp 52. The rings come to rest in ring collector mechanism 54, which holds accumulated rings and provides a specific amount of rings to playing piece dispenser 22. Ring collector mechanism 54 is described in greater detail with respect to FIGS. 6*a* and 6*b*. The rings released by mechanism 54 are collected before a release door 56 of playing piece dispenser 22 and are released into the dispenser upon receiving an appropriate signal from the control system. A player may then open front panel door 58 of playing piece dispenser 22 to obtain one or more rings 40. Playing piece dispenser 22 is described in greater detail with reference to FIG. 7.

A coin box and award dispenser box (not shown) are preferably positioned close to front panel 16*a* and store coins deposited into coin slot 24 and awards dispensed by award dispenser 20, respectively. Coin and award boxes suitable for use in game apparatus 10 are readily available on the commercial market. The comb lifting mechanism 50, ring collector mechanism 54, and playing piece dispenser 22 are controlled by control signals from the control system, which is detailed subsequently with reference to FIG. 8.

Figure 3:
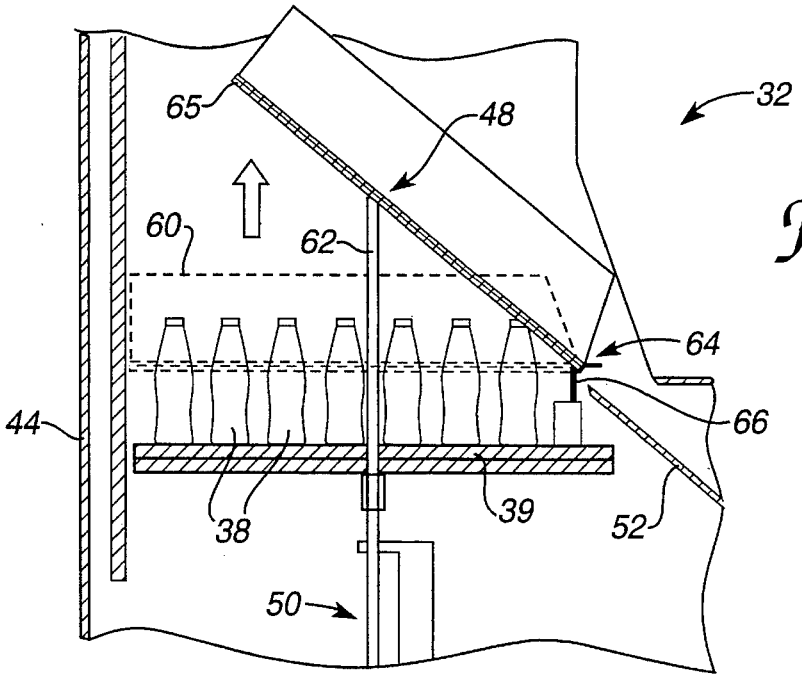
FIG. 3 is a partial side elevational view of the target field of the game apparatus of the present invention.

FIG. 3 is a side detail view of target field 32. Comb 48 is in a game position as shown by dashed lines 60 during game play, in which the top portions of bottles 38 extend through apertures in comb 48 (shown with respect to FIG. 5a). When a game is over, comb lift mechanism 50 moves lift members 62 to tilt comb 48 in a direction shown by arrow 64 to a tilted position. Lift members 62 preferably engage comb 48 at about the middle of the comb. The front end 64 stays approximately stationary when members 62 move upward. Preferably, a spring 66 couples a front corner of comb 48 to a solid surface such as base 39. A spring is coupled to both front corners of comb 48 so that the front 64 of comb 48 moves slightly upward when members 62 move upward. When springs 66 are fully extended, the front 64 of comb 48 stays in place while the rest of comb 48 tilts, as shown.

In alternate embodiments, other couplings can be used to prevent front end 64 of comb 48 to move upward while the back end 65 of comb 48 is tilted. For example, a hinge or similar rigid coupling can be used to provide rotational movement of comb 48 about an axis parallel to front end 64. In some embodiments, a moveable member and rigid hinge coupling can provide front end 64 with a small amount of upward vertical movement before the comb 48 is tilted, similar to the upward movement allowed by spring 66.

Rings 40 slide off the comb in the tilted return position and move down ramp 52 to the ring release mechanism as described above. Once all rings have been moved from comb 48 (which is preferably verified using sensing apparatus 36), comb lift mechanism 50 then causes lift members 62 to lower, which lowers comb 48 to its game position as shown by dashed lines 60.

Other methods and apparatuses can also be used to return rings. For example, a target field 32 can be implemented which includes bottles 38 projecting from both top and bottom sides of base 39. Base 39 can be rotated 180 degrees (perpendicularly to the plane of base 39) to allow rings on the top set of bottles to fall into a collector, while the bottom set of bottles becomes the top set of bottles and is ready to receive rings in the next game. In a different embodiment, air- or other gas-displacement mechanisms can be used to channel a gas onto target field 32 to force playing pieces off of target field 32 to a collector.

Figure 4:
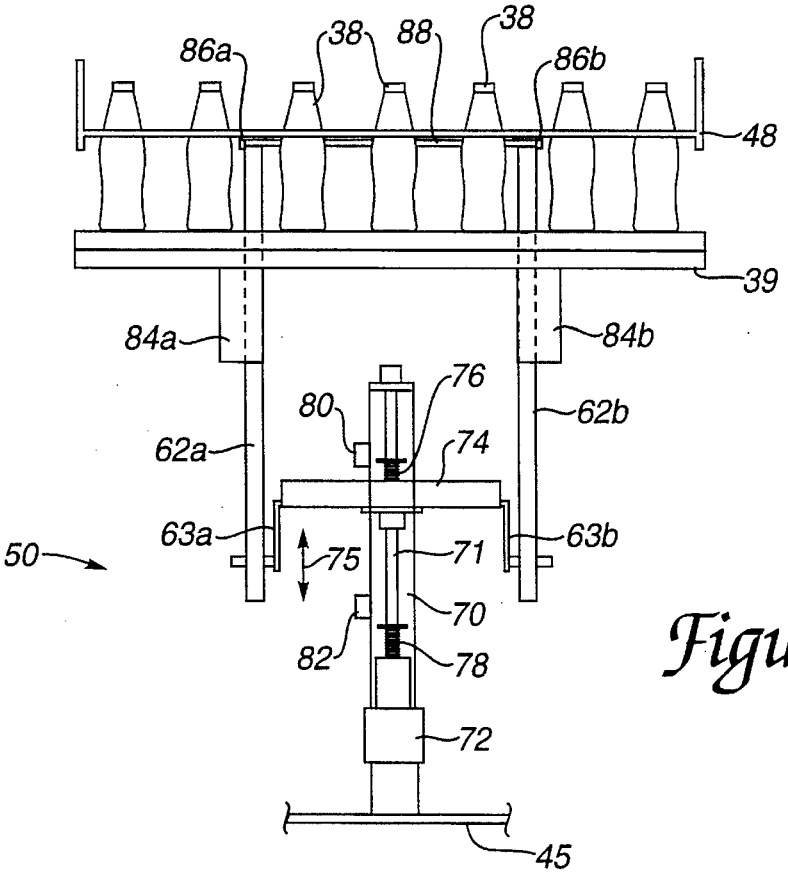
FIG. 4 is a side elevational view of the comb lifting mechanism taken along line 4—4 of FIG. 2.

FIG. 4 is a side view of comb lift mechanism 50 taken along line 4—4 of FIG. 2. Lift mechanism 50 preferably includes a support member 70, a shaft 71, a motor 72, a carriage member 74, lift members 62*a* and 62*b*, carriage spring 76, base spring 78, upper sensor 80 and lower sensor 82. Support member 70 supports shaft 71 and the other components of mechanism 50 in a vertical orientation (in other embodiments, mechanism 50 can be positioned in other orientations.) Shaft 71 is rotatably coupled to a top of support member 70 and to motor 72. Shaft 71 is preferably a threaded shaft such as a screw shaft so that a threaded object can be translated along shaft 71 when shaft 71 is rotated. Motor 72 is coupled to the game cabinet floor 45 or other base support and provides rotary force to shaft 71 when receiving an activation signal from the control system. Motor 72 can be, for example, a stepper motor or a DC servo motor.

Carriage member 74 is a threaded member that is coupled to threaded shaft 71. Carriage member 74 moves up and down shaft 71 as indicated by arrow 75 when shaft 71 is rotated by motor 72. Carriage spring 76 is coupled to carriage member 74 to provide a force cushion if carriage member 74 engages the top of support 76. Base spring 78 is coupled to motor 72 at the bottom of shaft 71 and provides a similar cushion to the limit of downward movement of carriage member 74. Springs 76 and 78 provide a safety mechanism so that if carriage member 74 moves into either force cushion provided by the springs, an overcurrent sensor (coupled to the drive mechanism for motor 71) senses the extra current required to move the carriage member and motor 72 is then deactivated to protect the comb lift mechanism 50.

Upper sensor 80 is positioned near the top of support 70 and detects when carriage member 74 has reached an allowed limit to upward movement. This limit to movement can correspond to the desired angle of tilt of comb 48 which will cause all rings 40 resting on the comb to slide off; for example, the comb can be tilted about 45 degrees from the horizontal game position. In the described embodiment, upper sensor 80 is a mechanical switch that is activated when carriage member 74 reaches its upper limit to movement. The sensor 80 signals the control system to deactivate motor 72 and stop the movement of the lift members 62*a* and 62*b*. Similarly, lower sensor 82 senses when carriage member reaches its lower limit to movement and signals the control system to deactivate motor 72 and stop the movement of the lift members. Many types of sensors 80 and 82 can be used, such as an electromagnetic (e.g., infrared) emitter/detector pair, a magnetic sensor, a motion sensor, etc., which are well known to those skilled in the art.

Lift members 62*a* and 62*b* are coupled to carriage member 74 by links 63*a* and 63*b*. Lift members 62*a* and 62*b* extend through guides 84*a* and 84*b*, respectively, which are coupled to the bottom of base 39 to prevent horizontal movement (i.e., perpendicular movement to the direction of arrow 75) of members 62*a* and 62*b*. Lift members 62*a* and 62*b* extend through apertures in base 39 and engage the bottom of comb 48. Preferably, comb guides 86*a* and 86*b* are coupled to the bottom of comb 48 to prevent horizontal movement of the lift members. A cross beam 88 also preferably couples lift member 62*a* to lift member 62*b* to provide additional support and to engage a greater surface area of the bottom surface of comb 48.

Figure 5A:
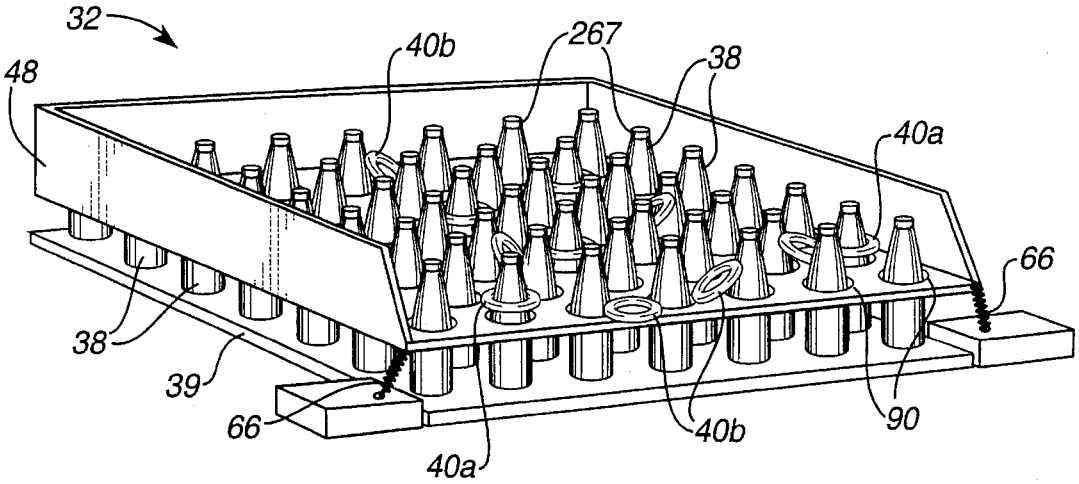
FIG. 5*a* is a perspective view of the target field with the comb in a game position.

FIG. 5*a* is a perspective view of target field 32 after a number of rings 40 have been tossed by a player onto the field. Some rings 40*a* have landed over bottles 38 such that the bottles extend through the central opening of the rings. Other rings 40*b* have not landed on bottles and are resting on comb 48 or against a bottle 38. Comb 48 is in its game position such that bottles 38 extend through apertures 90 in comb 48. Base 39, on which bottles 38 are supported, is also shown. Springs 66 are shown coupled between the front corners of comb 48 and support 39. Bottles 38 are preferably capped by bottlecaps 267 or a similar marking which are used to located bottles and rings by sensing apparatus 36, as described subsequently.

Figure 5B:
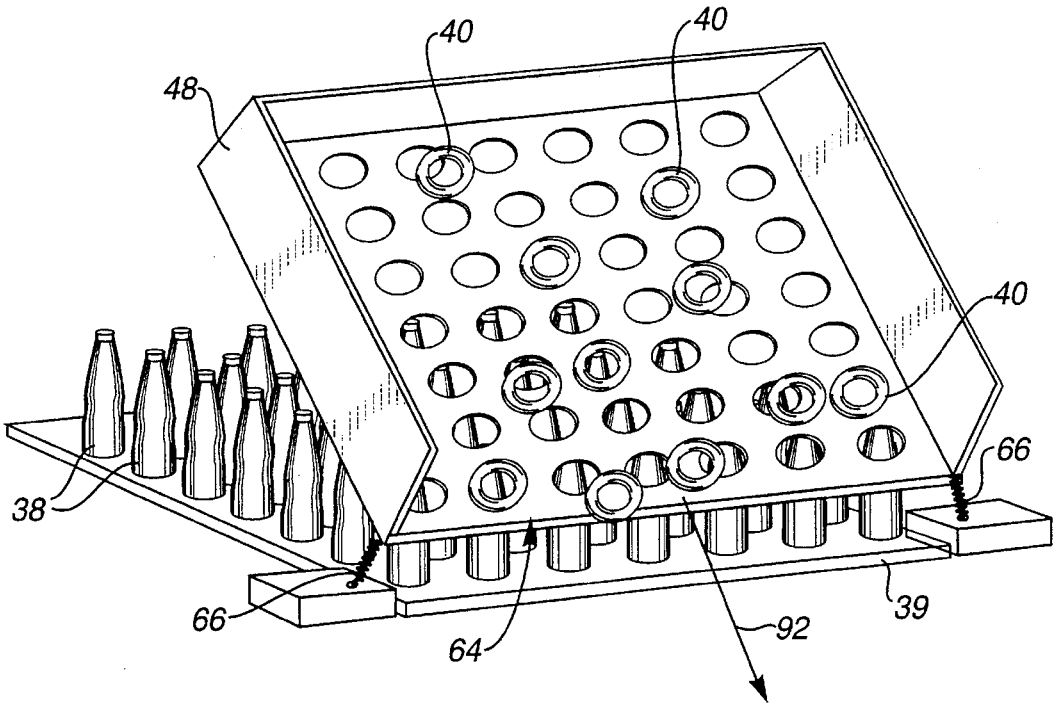
FIG. 5*b* is a perspective view of the target field with the comb in a tilted position.

FIG. 5*b* is a perspective view of target field 32 after comb lift mechanism 50 has moved lift members 62*a* and 62*b* upwards to cause comb 48 to tilt. Comb 48 has been tilted above the bottles 38 so that rings 40 are free to slide down in the direction of arrow 92 under the influence of gravity. Springs 66 keep front end 64 in approximately a stationary position. The sides of game cabinet 44 (not shown) help guide comb 48 when it is tilted and prevent comb 48 from moving horizontally when lifted. After rings 40 have all moved off comb 48, the lift members 62*a* and 62*b* are lowered, which lowers comb 48 to the position shown in FIG. 5*a*.

Figure 6A:
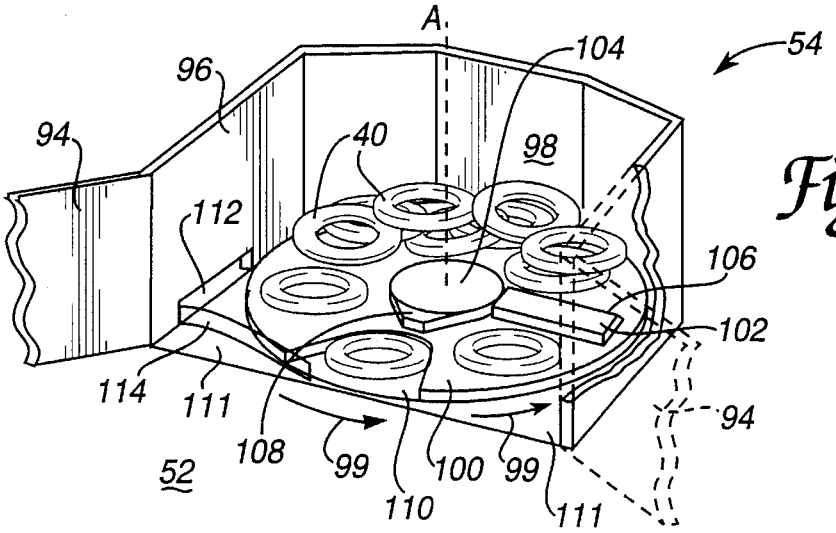
FIG. 6*a* is a perspective view of a playing piece collector mechanism of the present invention.

FIG. 6*a* is a perspective view of ring collector mechanism 54 as shown in FIG. 2. Ring collector mechanism 54 is preferably provided as a box-like container for receiving rings that have slid off of comb 48. As the rings travel down ramp 52 under the influence of gravity, they may bump into guide walls 94 which help direct the rings toward ring collector mechanism 54.

Rings 40 collect in receptacle 96 and may impact back wall 98 before coming to rest. Within receptacle 96 is a turntable 100 that is a circular-shaped member that rotates about a central axis A, for example, in the direction of arrow 99. Turntable 100 is preferably caused to rotate about axis A from a motor (not shown) positioned underneath receptacle 96 and having a shaft connected to the center portion of turntable 100.

Turntable 100 includes a main agitator 102 and a central agitator 104. Main agitator 102 is positioned on the surface of turntable 100 and roughly extends from the center of the turntable to an edge of the turntable. A beveled edge 106 is preferably included which is the leading edge of agitator 102 in the direction of rotation. Agitator 102 scatters or "agitates" rings 40 as the turntable 100 rotates so that a ring will fall into the dispensing slot (described below). Central agitator 104 is positioned at the center of rotation of turntable 100 and includes a projecting edge 108 on one or more sides. Central agitator 104 serves a similar purpose to main agitator 102 in scattering and moving rings 40, as described below.

Within turntable 100 is a dispensing slot 110. Slot 110 is sized and shaped slightly larger than a ring so that a ring can easily fall into slot 110. Slot 110 is also provided with enough height to fit one ring such that additional rings will not fill slot 110 after one ring has fallen in. Preferably, the areas 111 outside of turntable 100 are filled with solid material or are provided with a short wall around turntable 100 to prevent ring 40 that rests in slot 110 from moving out of the slot. The ring 40 that is held by slot 110 is dispensed from ring collector mechanism 54 out of aperture 112 that is provided in one wall of receptacle 96. Dispensing member 114 and centripetal force from turntable 100 help urge a ring out of dispensing slot 110 and out the aperture 112. The operation of ring collector mechanism is described in greater detail with respect to FIG. 6*b*.

Figure 6B:
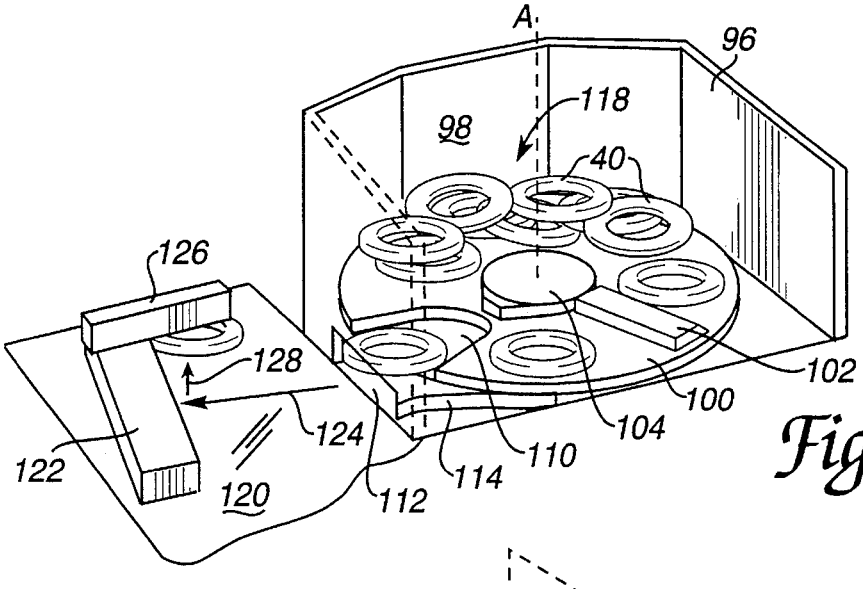
FIG. 6*b* is a perspective view of the playing piece collector mechanism providing a playing piece to the playing piece dispenser.

FIG. 6*b* is a perspective view of ring collector mechanism 54 and a ring sensor 126 for detecting a dispensed ring. The operation of ring release mechanism is briefly described as follows. A number of rings 40 are collected in receptacle 96. When a game is begun by a player inserting a coin, a specific number of rings 40, such as ten, are dispensed out of receptacle 96. This is accomplished by first activating the motor that rotates turntable 100. As turntable 100 rotates, main agitator 102 moves into a collection 118 of rings 40 that have congregated against back wall 98. These rings do not typically move with turntable 100 since back wall 98, preferably shaped as a rough "U", has caught them. Agitator 102 scatters the rings so that no large piles of rings collect. Central agitator 104 similarly breaks up bunches of rings that have collected together. In the preferred embodiment, a current sensor is coupled to a driver circuit that powers the motor driving turntable 100. If the current sensor senses an overcurrent, this indicates a jam has occurred in collector 54, preventing or hindering the rotation of turntable 100. If this occurs, the control system preferably causes turntable 100 to rotate in the opposite direction for a short distance to clear any blocking rings.

Eventually, dispensing slot 110 rotates about axis A enough to a catch a ring that falls into slot 110. When the slot 110 moves in front of dispensing aperture 112, the ring 40 in the slot 110 moves out the dispensing aperture, urged by centripetal force produced by turntable 100 and dispensing member 114. Dispensing slot 110 then rotates within receptacle 96 to catch another ring, which is then dispensed; this procedure is repeated for all rings provided to dispenser 22.

A dispensed ring 40 has enough momentum moving out of aperture 112, in addition to the force from gravity, to move across inclined surface 120 and into sensor guide 122, as shown by arrow 124. The ring impacts sensor guide 122 and moves down inclined surface 120 to ring sensor 126, as shown by arrow 128. Ring sensor 126 allows the ring to pass underneath a sensing end of the sensor. Sensor 126 detects the rings and signals the control system that a ring has been dispensed. Ring sensor 126 can be any suitable sensor as is well known to those skilled in the art, such as a mechanical switch, an electromagnetic emitter/detector pair (such as an infrared sensor), a motion detector, etc. After ring 40 passes through ring sensor 126, the ring moves into playing piece dispenser 22, which is described in detail with respect to FIG. 7.

When all dispensed rings have been tossed by a player onto target field 32, comb 48 is tilted and the rings move down ramp 52 as described above. The rings fall into receptacle 96. Preferably, collector mechanism 54b provides a predetermined number of rings to dispenser 22 while a game is occurring so that the rings can be quickly dispensed to the player of the next game after the current game. Alternatively, the game waits for a coin to be inserted before rings are dispensed from collector mechanism 54.

Figure 7:
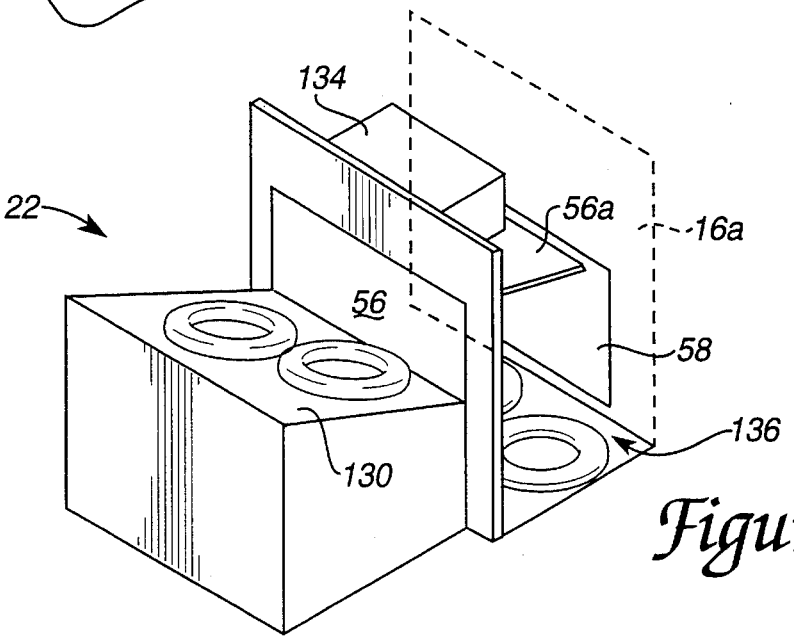
FIG. 7 is a perspective view of the playing piece dispenser of the present invention.

FIG. 7 is a perspective view of playing piece dispenser 22. After the rings pass by ring sensor 126 as shown in FIG. 6*b*, rings 40 slide down ramp 130 under the influence of gravity and the forces from the rotation of turntable 100. Rings 40 collect at release door 56, which is closed. When the determined number of rings have been dispensed and have collected in front of door 56, the control system preferably waits for a coin to be inserted into coin slot 24, indicating a new game has begun. At this time, the control system provides an activation signal to a solenoid 134, which opens door 56 to an upright position, shown as door 56*a*. Rings 40 can then freely fall into dispensing pocket 136, and the solenoid is deactivated to allow door 56 to close. Not all rings may fall out with one opening of door 56, so that the solenoid is preferably activated a second time to allow any remaining rings to fall into dispensing pocket 136. A player may then reach into dispensing pocket 136 by pushing hinged door 58 of dispenser 22 in front panel 16*a* and pick up one or more playing pieces for use in a game.

Figure 8:
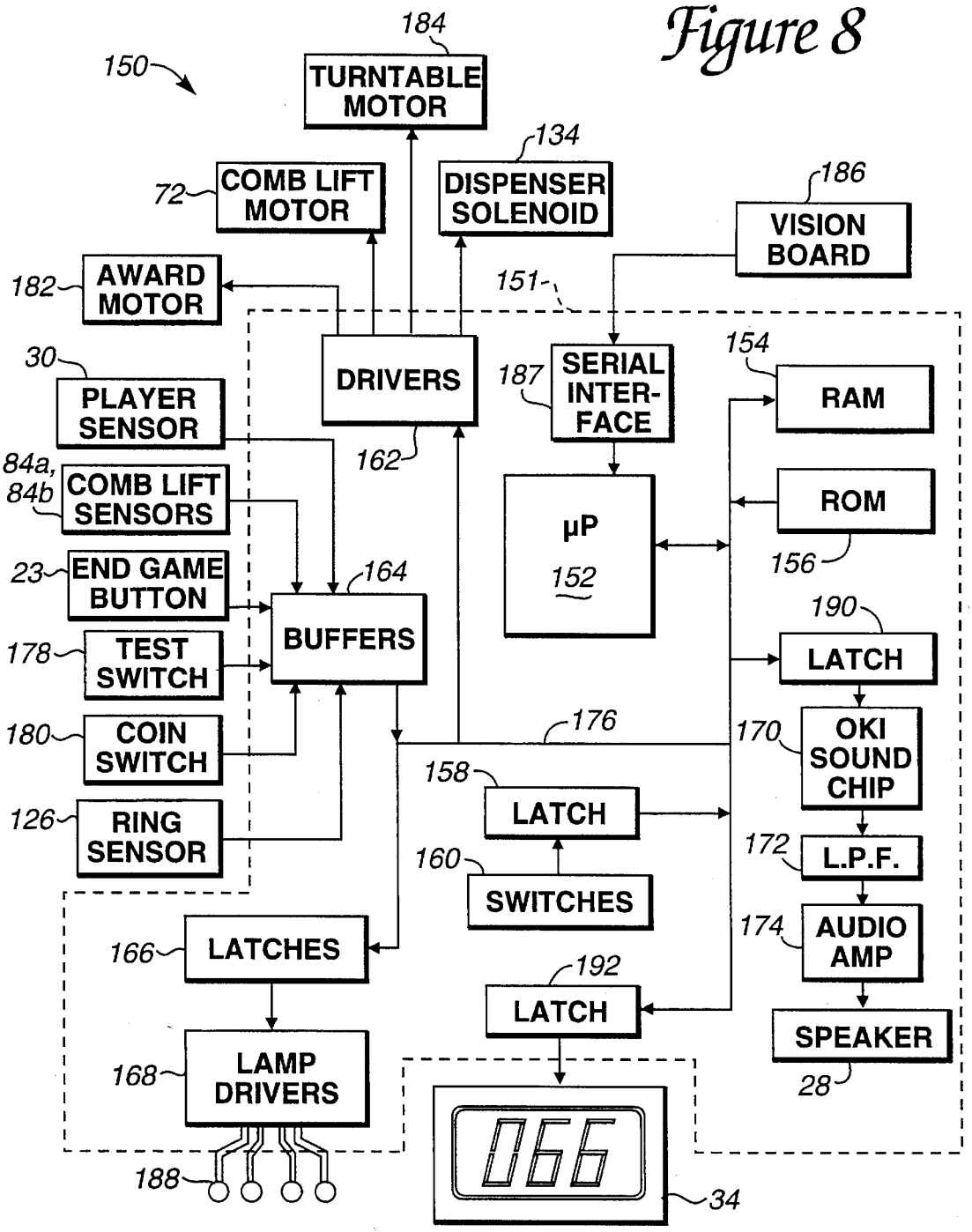
FIG. 8 is a block diagram of the control system for the game apparatus of the present invention.

FIG. 8 is a block diagram of a control system 150 of game apparatus 10. The control system, for example, can be implemented on one or more printed circuit boards 151 which can be coupled to game cabinet 44, behind front panel 16*a* or 16*b*, etc. The components of control system 150 include a microprocessor 152, RAM 154, ROM 156, a latch 158, DIP switches 160, drivers 162, buffers 164, latches 166, lamp drivers 168, sound chip 170, low pass filter 172, audio amplifier 174, and speakers 28.

The microprocessor 152 is preferably a standard microprocessor such as the 8-bit Intel 8031, which has the range of features adequate for the task, including eight data lines and sixteen address lines. The microprocessor 152 is coupled to ROM 156 by a data/address/control bus 176. The ROM 156 is preferably an erasable, programmable read-only memory (EPROM) that contains the start-up instructions and operating system for the microprocessor 152. Microprocessor 152 is connected to RAM 154 by bus 176 to permit the use of RAM for scratch-pad memory. Methods for coupling ROM 156 and RAM 154 to the microprocessor 152 by bus 176 including enable, address, and control lines are well-known to those skilled in the art.

The microprocessor 152 is also coupled to a latch 158 by the bus 176. The switches 160 coupled to latch 158 provide selectable functions that the operator of the game unit may change to his or her liking. These selectable functions can include the score achieved for landing a ring or other playing piece on a bottle (or other target), the time period that the game apparatus waits before assuming a game is over, etc. These factors can affect game play and the score achieved by a player. Other functions selectable by switches 160 include sound effects, the test mode, the type of game, and so on, depending on how many selectable functions are desired. Switches 160 can, for example, be implemented as DIP switches. Alternatively, the functions selected by switches 160 can be selected from another input device, such as a control panel of buttons, through software commands to the microprocessor 152, etc.

The microprocessor 152 is also coupled to drivers 162 and buffers 164. The buffers 164 receive data from several switches and sensors, including test switch 178, coin slot switch 180, comb lift sensors 84*a* and 84*b*, ring sensor 126, end game button 23, and player sensor 30. Test switch 178 can be a switch location in the interior of game apparatus 10 accessible to the operator which activates a test mode for the game apparatus 10 to determine if the game is operating correctly. Coin slot switch 180 detects when a coin has been inserted into the coin slot 24 of the front panel 16*a*. Comb lift sensors detect the limits to the upward and downward tilting movement of comb 48, as described with reference to FIG. 4. Ring sensor 126 detects each ring 40 as it is dispensed to playing piece dispenser 22 from the ring release mechanism 54, as described with reference to FIG. 6*b*. End game button 23, when pushed, signals to end the game, calculate a score, and dispense an award (if applicable). Player sensor 30 sends a signal to microprocessor 152 when a person is sensed within its field of detection to cause the game to end and thus help prevent a player from cheating and getting too close to target field 32, as described with reference to FIG. 1.

Drivers 162 activate output devices including award dispenser motor 182, comb lift motor 72, turntable motor 184, and dispenser door solenoid 134. Award dispenser motor 182 drives the award dispenser 20 in front panel 16*a* that provides tickets or other awards to a player. Comb lift motor 72 drives the comb lift mechanism 50 for tilting comb 48 and moving tossed rings from the target field 32. Turntable motor 184 drives turntable 100 of ring collector mechanism 54 to provide rings to ring dispenser 22. Dispenser door solenoid 134 is activated to open dispenser door 56 and provide rings 40 to a player of game apparatus 10.

Vision board 186 is preferably coupled directly to microprocessor 152 through a serial communication interface 187 and includes components for sensing apparatus 36 used to detect and verify tossed playing pieces on target field 32. Vision board 186 is described in greater detail with respect to FIG. 9.

The microprocessor 152 is also coupled to latches 166 which latch data for the lamp drivers 168. The lamp drivers 168 supply power to the lamps 188, which include lights around the perimeter of game cabinet 44, front panels 16*a* and 16*b*, target field 32, and other similar areas which can be highlighted as part of game action. In the preferred embodiment, components such as the motors 182, 72, and 184 and lamps 122 are powered by a commercially available 110 V AC power supply and power converters, which are well known in the art.

The microprocessor 152 is also coupled to a sound chip 170 which can be, for example, an OKI Voice Synthesis LSI chip available from OKI Semiconductor of San Jose, Calif. that has eight data input lines coupled to the microprocessor 152 by a latch 190. The sound chip 170 can receive its data from ROMs (not shown) and preferably outputs sound data to a low pass filter 172, an audio power amplifier 174, and finally to the output speakers 28, which generate sounds to the player playing the game apparatus 10, as is well known to those skilled in the art.

The microprocessor 152 is also coupled to game score display 34 by a latch 192. The game score display displays the game score as calculated by microprocessor 152 and can be a 7-segment LED digit display or similar display. Additional displays 34 can also be connected in alternate embodiments.

The preferred embodiment of the control system 152 operates briefly as follows. The microprocessor 152 first reads the low memory from ROM 156 over bus 176 and sequences through the software instructions stored in ROM. The settings of DIP switches in the switches block 160 are also read into the microprocessor. The software from the ROM 156 then instructs the microprocessor 152 to send and receive data over the bus 176 in order to conduct a game. For example, when the coin switch 180 is activated, indicating a coin has been inserted into coin slot 24, the microprocessor receives a signal from the buffers 164 on bus 176. The microprocessor then activates dispenser door solenoid 134 to dispense rings that are positioned behind release door 56 to the player in playing piece dispenser 22. As a game is played, microprocessor 152 preferably activates turntable motor 184 through drivers 162 to cause the turntable 100 of ring collector mechanism 54 to rotate and dispense a predetermined number of rings to the door 56 of ring dispenser 22. Ring sensor 126 indicates when the predetermined number of dispensed rings have been collected at door 56, and these rings are thus ready to be dispensed for the next game.

After dispensing the playing pieces to the player, the microprocessor activates sensing apparatus 36 on vision board 186 and waits for signals from sensing apparatus 36 and vision board 186 indicating how many valid rings have been tossed over bottles 38 and when all the rings have been tossed by the player. The process of determining which rings are on a bottle is described in greater detail with respect to FIG. 10. The microprocessor then sends a signal to the comb lift motor 72 to tilt the comb 84 to cause the rings 40 on the comb to slide into ring collector mechanism 54. An activation signal is then sent to award dispenser motor 182 by microprocessor 152 to dispense an award, if any, based on the calculated game score. Once the game is over, the microprocessor awaits another signal from coin switch 180 indicating another coin has been deposited in coin slot 16. During game play, the microprocessor sends appropriate output signals over bus 176 to activate speakers 28 and lamps 188 whenever game action occurs, such as when sensing apparatus 36 determines that a ring is in flight, has landed on a bottle, or has missed the target field. The microprocessor also sends signals to update game score display 34 during a game. The operation of the preferred embodiment of the game apparatus is described in greater detail with respect to FIG. 10.

Figure 9:
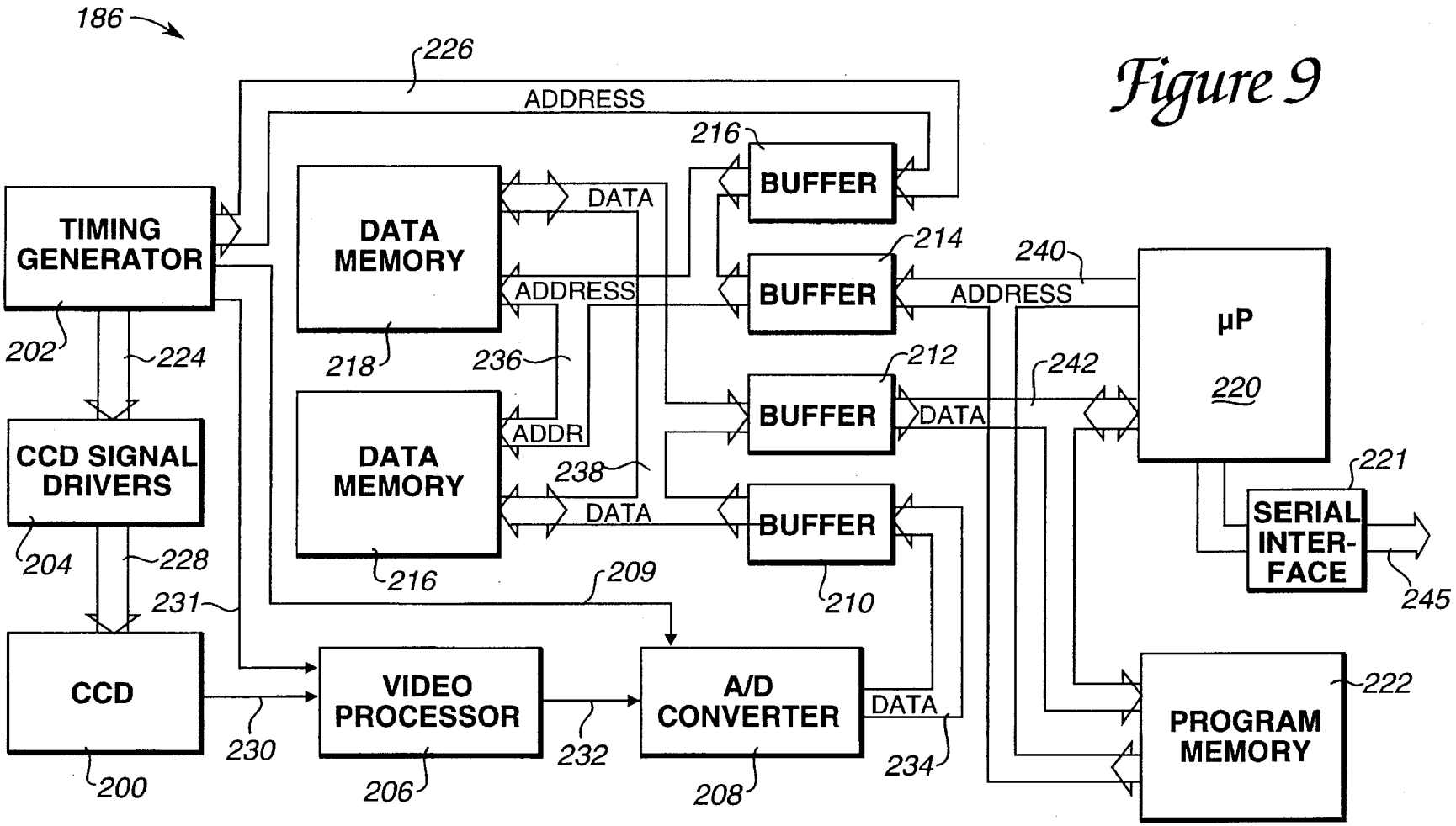
FIG. 9 is a block diagram of the vision board controlling the sensing apparatus of the present invention.

FIG. 9 is a block diagram of a preferred vision board 186 coupled to microprocessor 152 as shown in FIG. 8. Vision board 186 is preferably coupled to sensing apparatus 36, which can be a video camera or a similar device. The components of vision board 186 can be implemented on one or more circuit boards, separate from control system 150; or the control system and vision board components can be integrated on a single board. The vision board components control the operation of the sensing apparatus 36 and process the data sensed by the sensing apparatus. In the described embodiment, vision board 186 includes charge coupled device (CCD) 200, timing generator 202, CCD signal drivers 204, video processor 206, analog to digital (A/D) converter 208, buffers 210, 212, 214, and 216, data memory banks 216 and 218, microprocessor 220, and program memory 222.

CCD 200 is an image sensing device that senses different wavelengths of light directed at photosensitive elements positioned on the CCD. For example, a number of photosensitive elements on the CCD can be arranged linearly along the top surface of the device, where the elements sense black and white shades of light. In the preferred embodiment, CCD 200 is a black and white CCD that senses shades of gray and produces black and white video signals. A suitable CCD for use in vision board 186 is TC255 from Texas Instruments. CCD 200 receives light from a camera lens, fiber optic cables, or other light guide depicting the image of target field 32 as viewed from above at the position of sensing apparatus 36 (as shown in FIGS. 1 and 2 ). Receiving light images of a scene and sensing the images with a CCD is well-known to those skilled in the art. In alternate embodiments, a color CCD or equivalent device can be used to sense colors in a signal received by a camera or other sensing apparatus 36 and provide an appropriate video signal.

Timing generator 202 is used to generate timing signals used to control the CCD 200 to read incoming light images and provide video data signals describing the received light images. Timing generator also generates signals to control video processor 206 and A/D converter 208, as described below. Finally, timing generator 202 sends out addresses to memory banks 216 and 218 to store video data in the memory banks, as described below. A suitable timing generator is EMP7096 from Ahera. CCD signal drivers 204 receive the timing signals from timing generator 202 and condition these signals for use with CCD 200. CCD signal drivers also have access to amplitude adjustment potentiometers (not shown), which condition the amplitude of the timing signals for CCD 200. Suitable CCD signal drivers include SN28846 from Texas Instruments. Conditioning timing signals for a CCD is well-known to those skilled in the art.

CCD 200 outputs a CCD video signal on line 230 to video processor 206, which modifies the video signal to produce an encoded video signal. Processor 206 requires a number of video timing signals so that it can process the CCD video signal correctly. The timing signals are provided by timing generator on bus 231 and include such signals as a composite sync signal, a clamp signal, a blanking signal, and a sample and hold signal. Such timing signals in the generation of an encoded video signal are well known to those skilled in the art. Video processor 206 outputs an encoded, preferably black and white video signal that can be viewed by an external TV monitor, if desired. Such a monitor can be used to test and diagnose vision board 186. A suitable video processor is CXA131OAQ from Sony Corporation.

A/D converter 108 receives the encoded video signal from video processor 206 and converts the analog video signal into a digital signal. A clock signal provided by timing generator 202 on line 209 sets the sampling rate for A/D converter 208. This clock signal is synchronous with the video timing signals provided by timing generator 202. A suitable A/D converter is the TDA8703 from Phillips.

A/D converter 208 outputs the digital video signal on bus 234 to buffer 210, which is used to synchronize data flow between the components of the vision board 186. The digital video data is output from buffer 210 to data memory 216 or data memory 218, depending on the video data. Preferably, one scan line of data is output at a time from CCD 200. A "scan line" is a horizontal line of pixels (picture elements) on a video image and screen, as is well known to those skilled in the art. The scan lines are typically numbered.

If the video data on bus 234 describes an even-numbered scan line of a video screen, it is stored in video memory bank 216. If the video data on bus 234 describes an odd-numbered scan line of a video screen, it stored in video memory bank 218. The address of bank 216 or bank 218 to write the video data is provided by timing generator 202. By providing the timing information to CCD 200, timing generator 202 knows whether incoming video data describes an even scan line or an odd scan line. Video data memory 216 and 218 are preferably static RAM and store, for example, 128 kilobytes (K). Video memories 216 and 218 receive addresses on address bus 236 through buffers 214 and 216. Video memories 216 and 218 also receive and provide data on data bus 238 through buffers 210 and 212, as described below.

Microprocessor 220 processes video data to provide information on the state of a game in progress to microprocessor 152 of control system 150. Microprocessor 220 is preferably a digital signal processor (DSP) chip that readily performs signal processing tasks. A suitable DSP chip is TMS320BC52 from Texas Instruments. Microprocessor 220 sends out addresses on address bus 240 to access data in video memories 216 and 218 and in program memory 222. Data is sent to and received from microprocessor 220 using data bus 242. When accessing video memories 216 and 218, buffers 212 and 214 are used to buffer addresses and data output by microprocessor 220 so that addresses and data sent by other components to video memories 216 and 218 can be correctly synchronized. For example, in the preferred embodiment, an even scan line of data is stored in video memory bank 216 and an odd scan line of data is stored in video memory bank 218. This arrangement allows microprocessor 220 to read a scan line of data from one of the memory banks while the next scan line from CCD 200 is written into the other memory bank. Buffers 210–216 allow this simultaneous data transfer to occur by buffering data and addresses at the appropriate times.

Program memory 222 stores program instructions for microprocessor 220. Program memory 222 is preferably an erasable programmable ROM (EPROM) that provides the program instructions to microprocessor 220 at the time game apparatus is powered up. Program data can be provided directly from program memory to microprocessor 220; or, as in the preferred embodiment, the data from program memory can be written into video memory banks 216 and 218 and provided to microprocessor 220 as needed. This latter embodiment can be useful when program memory 222 is, for example, only half the data width required for data provided to microprocessor 220. Microprocessor can address both banks 216 and 218 to receive program data of the proper data width.

Other components can also be added to allow microprocessor 220 as needed. For example, the TMS320BC52 DSP chip 220 of the described embodiment can access a maximum of 64 Kbytes memory. To allow the DSP chips to access a greater amount of memory, memory paging can be implemented by adding an I/O latch coupled to data bus 242 to store the paging information, as is well known to those skilled in the art. Other similar components and features can also be added to vision board 150.

Vision board 186 operates as follows. Program instructions from program memory 222 is initially provided to data memories 216 and 218 so that microprocessor 220 can access the instructions. CCD 200 senses light images of target field 32 and outputs video data describing these light images according to the timing signals from timing generator 202. The video data is processed by video processor 206, converted to a digital signal by A/D converter 208, and is stored in data memory 216 (if it is data describing an even scan line) or data memory 218 (if it is data describing an odd scan line) on data bus 238 at an address provided by timing generator 202 over address bus 226. Meanwhile, to reconstruct the image seen by sensing apparatus 36, microprocessor 220 reads the data in data memories 216 and 218 by sending addresses over bus 240 and reading data from bus 242. Microprocessor reads a predetermined number of scan lines from memories 216 and 218 to form a complete image. The analysis of the complete image is then performed as detailed below with reference to FIG. 10. Once the analysis is complete, microprocessor 220 sends data to microprocessor 152 through serial interface 221 and over outgoing bus 245 indicating the current number of rings on bottles and other information as detailed in the method of FIG. 10.

Figure 10:
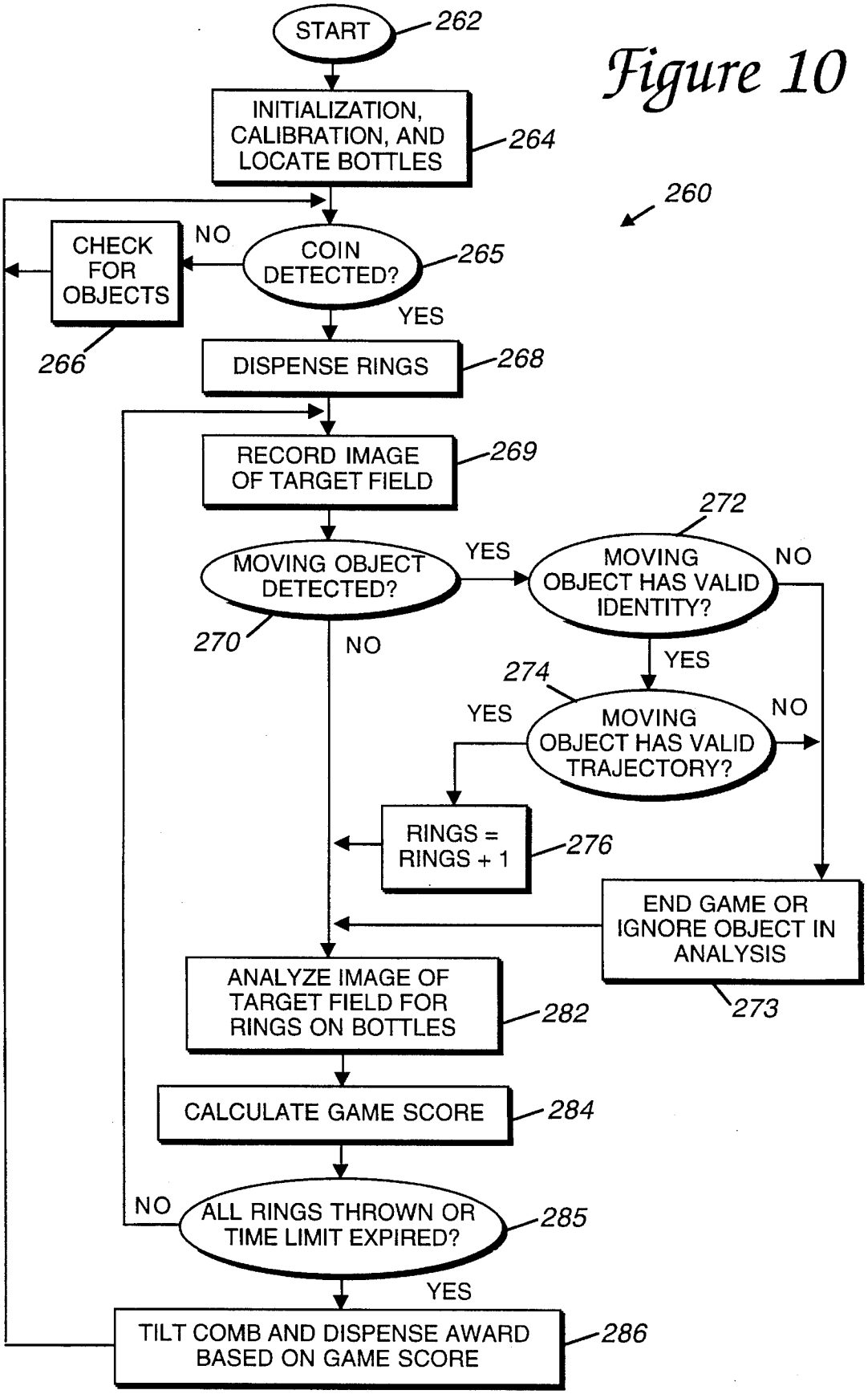
FIG. 10 is a flow diagram illustrating the process of operating and playing the game apparatus of the present invention.

FIG. 10 is a flow diagram illustrating a method 260 of operating and playing game apparatus 10. The process begins at 262. In step 264, initialization and calibration for a game is performed. This step is preferably performed when game apparatus 10 is first powered up or reset. In the described embodiment, the initialization includes setting the variable RINGS to 0, where RINGS is the number of rings (or other type of playing pieces in other embodiments) that have been detected as being tossed by the player.

In addition, calibration for validation and scoring steps are performed in step 264. "Validation" refers to the various steps in the current process for determining that a playing piece thrown by the player is a valid playing piece for the game that was dispensed to the player and not a false playing piece. Validation prevents a player from playing the game with different objects other than the dispensed playing pieces.

In the preferred embodiment, the targets on target field 32 are precisely located and the ambient lighting conditions are recorded for calibration purposes. In the described embodiment, an image of target field 32 is recorded by sensing apparatus 36 and stored in memories 216 and 218, where the image includes comb 48 and bottles 38.

FIG. 11 shows an example of an image 271 of target field 32 taken by sensing apparatus 36 (the image 271 taken in step 264 typically does not include images of rings 40 on bottles 38 or comb 48). In other embodiments, image 271 can show a greater area, such as target field 32 plus an area extending before target field 32. Sensing a greater area for image 271 can be useful in the above-described embodiment where sensing apparatus 36 is aimed more toward the player and in which sound effects and/or light effects are generated in response to a playing piece in flight. Image 271 is made up of a number of pixels (i.e. picture elements), preferably arranged in horizontal and vertical rows, that together form the image of the target field 32, as is well known to those skilled in the art. The pixels are stored as digital data in data video memories 216 and 218 derived from video data of the CCD, as described above with reference to FIG. 9. Each pixel has characteristic values indicating how bright the pixel is, what gray shade or color the pixel is, etc. In the described embodiment, each pixel has an intensity value ranging from 0–255 indicating the pixel's shade of gray.

Bottles 38 appear in image 271 in the middle of apertures 90 of comb 48. In the described embodiment, a "fish-eye" or similar type of lens of sensing apparatus 36 is used to record image 271 which causes some distortion in image 271. Preferably, sensing apparatus 36 is positioned directly above center bottle 38*a*. This causes bottles 38 surrounding center bottle 38*a* to be seen in varying degrees of distortion. For example, the image of bottle 38*b* is close to center bottle 38*a* and is distorted to a small degree. Bottle 38*c*, however, is some distance from bottle 38*a* and is thus shown greatly distorted since it is viewed somewhat from the side.

Image 271 is used to perform the calibration and locating step 264. Each bottle 38 is preferably capped by bottlecap 267. Bottlecap 267 is used to precisely locate each bottle 38. In alternate embodiments, other reference areas on targets 38 other than bottlecaps 267 can be used, as described below. In addition, microprocessor 220 preferably examines the pixels of image 271 describing each bottlecap 267 and records an average pixel intensity for each bottlecap. This is accomplished for calibration purposes. In addition, a ring intensity threshold is determined in step 264 using image 271. These steps are described in greater detail with respect to FIG. 12.

Step 264 is preferably implemented when game apparatus 10 is first power up or reset. Step 264 is also preferably performed periodically to ensure correct calibration. For example, the recalibration of step 264 can be implemented every two or three hours to compensate for changing ambient lighting conditions during the course of a day. Also, if game apparatus is moved or bottles 38 are moved, the location of bottles 38 might be changed. Step 264, when accomplished periodically, would allow microprocessor to know a precise location of bottles 38 at all times.

Referring back to FIG. 10, in step 265, the microprocessor 152 checks if a coin has been detected in coin slot 24 by checking input signals from coin switch 180. If no coin is detected, step 266 is implemented, in which a check for stray objects is implemented. In step 266, microprocessor 220 uses sensing apparatus 36 to determine if an object has been thrown into target field 32 when a game was not in progress. The microprocessor can detect the object in flight, as accomplished in steps 272 and 274 below; or the object can be detected at rest, as accomplished in step 282 below. If an object is detected, comb 48 is preferably lifted to remove all stray objects from target field 32. In some embodiments, step 266 can be implemented only periodically, such as every 10 minutes and/or after a coin is inserted and a game begins. After step 266, the process returns to step 265 to again check for a coin. When a coin is detected in coin slot 24 in step 265, the process continues to step 268 to begin a game.

In step 268, microprocessor 152 controls dispenser 22 to dispense a predetermined number of playing pieces, such as rings 40, to the player. For example, 10 rings which were loaded in front of door 52 during a previous game are dispensed in the preferred embodiment. Release door 52 is thus opened in step 268 to dispense the playing pieces. Next, step 269 is implemented, in which an image 271 of the target field is recorded by sensing apparatus 36 and stored in memories 216 and 218. This image shows any moving playing pieces in flight and any playing pieces in their current positions on target field 32. This image is analyzed in step 282, below. In the preferred embodiment, process 260 is implemented so that an image 271 is recorded in step 269 about 3 to 5 times a second.

In step 270, microprocessor 220 checks if an object has been detected within the range of vision of sensing apparatus 36. This range of vision, for example, can be the area shown within dashed lines 46 in FIG. 2. An "object", as referred herein, is a playing piece such as ring 40 or any other object or article which is directed into the field of vision of sensing apparatus 36.

To detect objects within the range of vision of sensing apparatus 36, microprocessor 220 examines image 271 of target field 32 taken in step 269. Microprocessor 220 can detect when an object passes into the field of vision by detecting a change of intensity of any pixels in the image. This is because rings 40 or other playing pieces appear as a different intensity (e.g. shade of gray) in image 217 of FIG. 11 than comb 48 or bottles 38. As microprocessor 220 analyzes each image that is taken and stored in memories 216 and 218, the pixels of a playing piece that enters the field of vision will appear, for example, lighter than pixels of comb 48. Microprocessor 220 knows an object has been thrown by the player when it finds such lighter pixels. The microprocessor can look for pixels, other than bottlecap 267 pixels, that have or have a value close to the ring intensity value calculated in step 264 and detailed in FIG. 12. For example, if the ring intensity value is typically 120 in a range of 0–255, pixels having an intensity in a range of 110–130 can be examined. In alternate embodiments, the playing pieces can be detected in image 271 using more elaborate methods, as described below for step 282. In yet other embodiments, a different color or other characteristic can be detected.

If an object is not detected in image 271 in step 270, step 282 is implemented, as detailed below. If an object is detected in step 270, step 272 is implemented, in which the microprocessor 220 checks if the moving object has a valid identity. This is a validation step to determine if the player is using the intended playing pieces that were dispensed in dispenser 22. In the preferred embodiment, the identity is determined by examining the size and shape of the playing piece. In alternate embodiments, the identity can also include the color or other characteristics of the playing piece.

The size of the object can be determined by examining the longest portion of the object in image 271 and comparing that portion to a predetermined range of lengths that have been stored in memory. For example, in FIG. 11, ring **40*d* may be in flight over comb 48 and bottles 38 and may be viewed from its edge in image 271 as it moves across target field 32. Microprocessor 220 can measure the longest portion, shown by distance d, to determine the size of ring 40*d*. Similarly, if a ring 40 were shown in a partial size view as an ellipse, microprocessor 220 can measure the major axis of the ellipse to determine the size (diameter) of the ring. The size of a coin and other types of regular playing pieces can be measured similarly. The shape of the playing piece can be determined by looking for a ring shape, for example, such as differently-colored pixels completely surrounding pixels of the background comb 48. For irregular playing pieces, such as elongated rods, cylinders, and other shapes, or to more accurately determine sizes and shapes of regular playing pieces, the microprocessor 220 can examine several images 271 taken successively over time to determine the size and shape of the object, measure different lengths of the object, etc. as it moves through the air or skips on and bounces off bottles 38** or other targets.

In the preferred embodiment, the microprocessor 220 can also employ image enhancement techniques to provide a more accurate representation of the object in image 271, if such an enhancement is needed. For example, several edge detection methods, such as Sobel edge detection, are well known to those skilled in the art to provide higher resolution of an edge or other features of an object that have been represented as a collection of pixels. The original low resolution image is processed by these techniques to provide a higher resolution picture. Using such techniques, microprocessor 220 can measure an object more accurately to determine if the object is valid. The enhancement techniques can be used for any step of process 160 that requires analysis of image 271.

The microprocessor can compare the size of the object to a range of predetermined sizes to which the size of a valid playing piece should correspond. If the object is determined to be a great degree outside this range of valid sizes (such as by a factor of 2 or more), then the object is assumed to be invalid and the process continues to step 273, described below. If the object is within the range of sizes, or marginally outside the range of sizes, then the object is assumed valid (or too close in size to a playing piece to accurately determine validity). For example, a playing piece might be tossed so that it moves very near to sensing apparatus 36, in which case it might appear slightly larger than the valid range of sizes yet still be a valid playing pieces. In such a case, the playing piece would have a size just outside the range of valid sizes and would thus be assumed valid (other validation procedures preferably determine its validity more accurately later in the process, such as in step 282).

Other steps can be employed to determine validity of the object depending on the complexity and thoroughness of the desired validation procedure. For example, microprocessor 220 can examine every image taken during the flight of the object to determine the size and shape of the object.

If the object is found to have a valid identity in step 272, then step 274 is implemented, in which microprocessor 220 determines if the moving object has a valid trajectory. This is another validation step where the microprocessor examines several successive images 271 to determine a velocity vector for the object. Preferably, a minimum of 5 images 271 are examined to determine a trajectory of the object (if the minimum number of images have not been recorded yet, then step 282 is automatically implemented next). If the object is determined to be moving in a direction that is included in predetermined spatial constraints, then the object's trajectory is validated. For example, in the described embodiment, an object's trajectory is validated if the object enters image 271 from the front edge at the bottom of FIG. 11 and moves toward an different side of image 271, i.e., the object has been thrown from the direction of front panel 16*a*. An object's trajectory would not be validated if the object was determined to have entered the field of vision of sensing apparatus 36 from the side or top of image 271 toward the opposite side of image 271. An invalid trajectory might occur, for example, if a player breaks open side netting 33 or cabinet 44 to throw an object from that position and get easy access to targets 38, or if a player is able to place a playing piece on a target in target field 32 with his or her hand without activating player sensor 30. Other trajectories can be considered valid or invalid in other embodiments.

Additional trajectory validation can be implemented if desired. For example, in the described embodiment, only the direction of flight of the moving object is determined; however, in other embodiments, the speed of the object can also be checked by examining successive images 271 and determining the distance traveled by the object between images. The speed can be calculated since the distance traveled by the object and the time between recorded images is known. Such speed validation might be useful, for example, to invalidate playing pieces that are thrown too fast by a player to encourage a safer environment to players.

If the object's trajectory was found to be outside the acceptable range of trajectories in step 274, then the object is considered invalid and step 273 is implemented, described below. If the object was found to have a valid trajectory, then step 276 is implemented, in which the variable RINGS is incremented by one; i.e., it is assumed that the detected object is a valid playing piece for the game and the count of thrown playing pieces is increased. The process then continues to step 282.

In step 273, the detected object is considered invalid from step 272 or step 274 and either the game is ended or the invalidated object is ignored in any further analysis. In one embodiment, the game can be ended when any invalid object is detected during a game. This action tries to deter players from cheating by throwing false objects to attempt to gain a greater score. Alternatively, the game can be terminated only for specific types of objects, such as very large objects or hard-thrown objects which could damage the game apparatus 10.

In a different embodiment, the invalidated object can be ignored in any further analysis. For example, in step 282 below, target field 32 is analyzed to determine which rings are in a scoring position. The invalidated object can be tracked by microprocessor 220 in successive images 271 and marked so that it is ignored in the analysis of step 282. No game score would thus result from the invalid object, but the player could continue to play the game. After step 273, the process continues to step 282.

In step 282, microprocessor 220 analyzes image 271 of target field 32 to determine which playing pieces are in a scoring position. Preferably, this step comprises examining each bottle 38 to determine if a ring has landed in scoring position. Step 282 is described in greater detail with reference to FIG. 14.

In next step 284, microprocessor 152 calculates a game score based on the information sent by microprocessor 220 about how many playing pieces are in a scoring position (e.g., how many rings 40 are on bottles 38) as determined by the last-recorded image 271. The game score can be increased by a predetermined number, such as 30 points, for each playing piece in a scoring position. Game score display 34 is preferably updated as well. In alternate embodiments, microprocessor 220 can also inform microprocessor 152 about any special scoring conditions. For example, if a ring lands on a special bottle 38 in the middle of target field 32 that yields a higher game score (or a special ring lands on a bottle, etc.), processor 220 can inform processor 152 that this condition has occurred. Microprocessor 152 could then increase the game score by a greater amount to reflect the special condition.

In step 285, the microprocessor 152 checks if all rings (or other playing pieces) have been thrown by the player or if a time limit for the game has expired. Microprocessor 152 checks if RINGS is currently equal to the number of playing pieces dispensed in step 267. If so, then the player has thrown all of the dispensed playing pieces and the game is over. Or, if the time limit has expired, the game is over. This time limit was preferably started when the first object was detected by sensing apparatus 36; or, alternatively, when a coin was detected in step 265. In the described embodiment, the time limit is about 30 seconds; however, this time limit can vary depending on the number of playing pieces dispensed to the player and the desired difficulty of the game. A check is also made in step 285 to determine if the player pushed the end game button 23, which indicates that the player has selected to end the game (e.g., the count of RINGS may have been inaccurate). The check for end game button 23 can also be used when the variable RINGS is not used in some embodiments. If any of the checks indicate the game is not over, the process returns to step 269. If the game is over, the process continues to step 286.

In step 286, microprocessor 152 tilts comb 48 to remove all playing pieces as described above. In addition, in step 286, microprocessor 152 dispenses an award to the player from award dispenser 20 based on the final game score. The process then returns to step 265 to check for another coin to be inserted into coin slot 24 by a player.

It should be noted that some steps presented in the method of FIG. 10 can be omitted depending on the degree of playing piece validation desired. For example, step 272 of validating the size of an object in flight and/or step 274 of validating the trajectory of an object can be omitted in some embodiments, leaving only the analysis of step 282 to validate the playing pieces that have come to rest in target field 32. Step 276 of counting thrown rings can also be omitted so that only the expiration of the time limit or the activation of end game button 23 can end a game.

FIG. 12 is a flow diagram illustrating step 264 of FIG. 10, in which microprocessor 220 precisely locates the bottles 38 of target field 32 and calibrates the intensity levels used for later analysis. As used herein, "bottlecap" refers to a portion of each target bottle 38 that has pixels of different intensity than the rest of bottle 38 and comb 48. The bottlecaps are used as reference points to detect rings 40. In other embodiments, the "bottlecap" can be a different reference point or marking, such as the center of a different target container, a differently colored portion of a target, etc.

The process begins at 290, and, in iterative step 292, a counter variable n is initialized to zero and compared to the number of bottlecaps 267 in target field 32 (which is the same as the number of bottles 38). If n is less than the number of bottlecaps, then step 294 is implemented, in which a bottlecap mask is compared to the bottlecap image of bottlecap(n).

A "mask", as referred to herein, is a number of pixels, such as a bit map or pixel map, that is stored in memory (preferably program memory 222) and define a shape or image in a predefined area. The bottlecap mask is preferably a number of pixels in a rectangular area that define a circular shape having the same measurements as bottlecaps 267. See, for example, bottlecap mask 293 as shown in FIG. 271. The white circular area 295 includes pixels that are "on," i.e., have a non-zero value. Black pixels 297 are "off" and have a zero value.

In step 294, the bottlecap mask is compared to pixels of image 271 at the location of a bottle(n) to find an accurate location of bottlecap(n). This is described in greater detail with respect to FIG. 13. In next step 296, microprocessor 220 reads the intensity of a selected number of pixels of image 271 describing the bottlecap(n) found in step 294. In the described embodiment, the intensities of nine pixels at or near the center of the found bottlecap(n) are read. These nine intensity values are averaged in step 298, resulting in an average intensity(n) for bottlecap(n).

Once the bottlecap is accurately located and an average intensity(n) is calculated, the process returns to step 292 to increment n and implement steps 294, 296, and 298 for the next bottlecap.

The image 271 recorded and used in steps 292–298 above can also be used to calibrate for large changes in ambient light of target field 32. Image 271 can be stored and remembered by microprocessor 220 so that, at a later time (as in step 282 of FIG. 10), this stored image can be compared to an image taken when rings are analyzed to determine if the ambient light has greatly changed, which can possibly invalidate the results of the game. This is described in greater detail in step 282 below.

After all the bottlecaps have been located in steps 292, 294, 296, and 298, n is equal to or greater than the number of bottlecaps in step 292 and the ring intensity thresholds are determined in steps 300, 302 and 304. A ring intensity threshold is preferably determined for each bottlecap(n). In iterative step 300, n is initialized to zero and compared to the number of bottlecaps 267 in target field 32. If n is less than the number of bottlecaps, then step 302 is implemented.

In step 302, a ring detection is attempted at bottlecap(n). This is preferably accomplished with a ring mask placed at the bottlecap location and using a starting intensity threshold of, for example, 120. The process of detecting a ring using a ring mask and intensity threshold is described below in greater detail with respect to FIG. 15. However, since no ring exists at any bottlecap at this step, no ring can be found. The intensity threshold is lowered in step 302 until a detection is made; this detection is a false detection. Once the false detection is made, the intensity threshold is raised to a new number in step 304. This new number is determined the ring intensity threshold(n) for bottlecap(n).

In the described embodiment, the intensity threshold is raised by a variable amount from the false detection level. The variable amount is determined by the average intensity(n) for the currently examined bottlecap(n) and the intensity of the background comb 48 pixels of image 271. For example, if there is small difference between the pixel intensities of bottlecap(n) and the background, then the intensity threshold is raised by a small amount, such as 0–10 (in a scale of 0–255). In the described embodiment, rings 40 will typically appear in image 271 with intensities slightly less than the bottlecaps; if the bottlecap intensity is close to the intensity of the background pixels at the false detection level, then the intensity threshold should not be raised very much above those background pixels. If, however, there is a large difference between pixel intensities of bottlecap(n) and the background, then ring intensity threshold(n) can be raised by a greater amount, such as 10–20 or more. In other embodiments, the pixel intensities of bottlecaps and playing pieces can be assumed to be different from each other by a fixed or variable amount. The variable amount that the ring intensity threshold is raised can also be affected by other environmental lighting conditions.

In alternate embodiments, the ring intensity threshold can be determined differently. For example, a ring can be examined in the current lighting conditions to determine the intensity of the rings and an intensity threshold can be determined therefrom. Or, rings can be assumed to have an intensity within, for example, 10 counts of a bottlecap intensity, and the threshold can set accordingly.

Once ring intensity threshold(n) is determined in step 304, the process returns to step 300 to determine the ring intensity threshold for the next bottlecap(n). When all bottlecaps have thus been examined, the process is complete at 306.

FIG. 13 is a flow diagram illustrating step 294 of FIG. 12, in which a bottlecap mask is compared to a portion of image 271 to determine the accurate location of bottlecap(n) 267. The process begins at 307, and in a step 308, the microprocessor 220 chooses an intensity threshold and a mask threshold. The intensity threshold defines the intensity of pixels in image 271 which describe a bottlecap. In the described embodiment, the intensity threshold is initially chosen as a number determined by previous tests, preferably a high number. For example, if pixel intensities range from 0–255, the bottlecap intensity threshold can be set to about 150 or even greater. When the first bottlecap(n) is found (bottlecap(O)), the intensity threshold may be lowered by some amount. The lowered intensity threshold can then be used for the rest of the bottlecaps.

The mask percentage threshold defines the minimum percentage of pixels of image 271 that must match pixels of the bottlecap mask for a bottlecap to be considered precisely located. The mask threshold is, initially, an arbitrary number that has been found to work well; for example, 70% is a reasonable mask threshold. The mask threshold can be altered if identification of a bottlecap is difficult, as described below in step 340. Also in step 308, a variable PIXEL_HITS is initialized to zero. PIXEL_HITS stores a count of how many image pixels in the mask area have a high enough intensity to be playing piece pixels, as described below.

In step 310, the bottlecap mask is placed at the approximate location of image 271 where bottlecap(n) should be located. The bottlecap mask is placed in an "approximate" location of a bottlecap, since the precise location is not known. The coordinates of all the bottlecaps are known by the microprocessor based on a typical image 217. Due to small adjustments and movements over time of base 39, sensing apparatus 36, and other components of the game apparatus 10, however, the precise location of bottlecaps 267 typically does not correspond to the known coordinates. The center of bottlecap mask 293 is preferably placed at the approximate center of bottlecap(n).

In step 312, the microprocessor 220 checks if all pixels in the bottlecap mask have been examined (i.e., compared with the corresponding image pixels). If so, then step 322 is implemented as described below. If there are unexamined mask pixels, then step 314 is implemented, in which the microprocessor examines the next mask pixel. The "next" mask pixel is the next pixel in a specified order of mask pixels. For example, a mask pixel order might be designated as pixels in a left to right, top to bottom order, similar to scan lines of a display screen.

In step 316, the microprocessor 220 checks if the examined mask pixel is equal to 0. This indicates the pixel is "off", i.e., a dark pixel 297 of bottlecap mask 293 as shown in FIG. 11. If so, then the process returns to step 312 to check for the next pixel. If the current pixel is not equal to zero, then step 318 is implemented. The microprocessor 220 checks if the image pixel of image 271 that corresponds to the current mask pixel (i.e., is "underneath" the current mask pixel) is greater than or equal to the intensity threshold. This step checks if a pixel has a great enough intensity to be part of a bottlecap. In alternate embodiments, a check can be made in this step for color intensity brightness, or a different characteristic of the image pixels. Also, if darker bottlecaps are used in other embodiments, this step can check for an image pixel intensity that is less than an intensity threshold.

If the corresponding image pixel intensity is less than the intensity threshold, then the process returns to step 312 to check the next pixel of the mask. If the image pixel intensity is greater than or equal to the intensity threshold, then step 320 is implemented, in which PIXEL_HITS is incremented. The process then returns to step 312 to check for the next pixel of the bottlecap mask.

If microprocessor 220 determines in step 312 that all mask pixels have been examined, then step 322 is implemented, in which the microprocessor divided PIXEL_HITS by the number of pixels in the bottlecap mask. This result (the "mask percentage") is the percentage of image pixels in the mask area that have a bottlecap pixel intensity. The mask percentage is compared to the mask threshold. If the mask percentage is greater than or equal to the mask threshold, then step 324 is implemented, in which the bottlecap(n) is considered precisely located. The process is then complete as indicated at 326.

If the mask percentage is less than the mask threshold in step 322, then no bottlecap has yet been found; this is a "failure" result to step 322. Step 328 is then implemented, in which the microprocessor checks if the mask has been moved to all designated positions. Bottlecap mask 293 has a predetermined number of positions that it is to be moved to if a failure results from step 322. Microprocessor 220 keeps track of the positions that the mask has been moved to. If the mask has not yet been moved to all of them, then step 330 is implemented, in which the mask is moved to the next position. In the described embodiment, bottlecap mask 293 has 100 positions. For example, the bottlecap mask can be moved to the right (x-coordinate incremented) by one pixel in step 330 (to the right in FIG. 11 ). If failure result again occurs in step 322, then the mask can again be moved one pixel to the right. If, after 10 movements failure still results in step 322, then the mask is reset to its original x position but have a y coordinate incremented (a movement down toward the bottom of FIG. 11 ). Thus, a 10×10 pixel grid is eventually checked. In alternate embodiments, the mask can be moved greater distances and/or in more positions. After the mask has been moved to the next position in step 330, step 332 is implemented, in which the examined mask pixels are reset, i.e., no pixels of the mask have now been examined (for the purposes of step 312) and the current mask pixel is set to the first mask pixel. The process then returns to step 312.

If the mask has been moved to all predetermined positions in step 328, then step 334 is implemented, in which microprocessor 220 checks if the intensity threshold has been decreased yet. If not, then the intensity threshold is decreased in step 336, preferably by a predetermined amount, such as 1 (in a range of 0–255). Also, the mask position is reset to its original position in step 336 so that all the positions of the mask (as defined in step 330) can be checked again at the new intensity threshold. After step 336, the examined mask pixels are reset in step 332 and the process returns to step 312.

If the intensity threshold has already been decreased in step 334, then a bottlecap/ring still cannot be identified. The microprocessor then checks in step 338 if the mask threshold is at a lower limit. That is, if the microprocessor already has lowered the mask threshold in a previous execution of the process, then a lower limit may have been reached. If the mask threshold is not at a lower limit, then step 340 is implemented, in which the mask threshold is decreased by a predetermined amount, such as 1%. The mask and intensity threshold are also preferably set back to their original states. The examined pixels are then reset in step 332 and the process returns to step 312.

The mask threshold is continually lowered in step 340 until either a bottlecap is found in step 322 or the lower mask threshold limit is reached in step 338. In the described embodiment, a suitable lower limit is 60%. If a ring is not identified on the current bottle after the lower limit is reached in step 340, then it is assumed that no bottlecap(n) or bottle(n) is present. That is, bottlecap(n) and bottle(n) will preferably be ignored in any analysis during a game, as in step 282 of FIG. 10; no playing piece can increase the game score by landing at that location. The process is then complete at 344.

Other methods of detecting a bottlecap can be used in alternate embodiments. For example, the microprocessor can look at specific pixels located a certain distance or angle apart from the approximate center of a bottlecap 267.

In some embodiments, if bottles 38 are not being used as targets, then a different reference point other than bottlecaps 267 can be used. For example, specific shapes can be positioned at the center of containers or other targets to provide a reference point to detect the precise location of targets like bottles 267.

FIG. 14 is a flow diagram illustrating step 282 of FIG. 10, in which microprocessor 220 analyzes image 271 during a game to determine if any rings or other playing pieces are in a scoring position on target field 32. The process begins at 346, and, in iterative step 348, a counter variable n is initialized to zero and compared to the number of bottlecaps 267 in target field 32 (which is the same as the number of bottles 38). If n is less than the number of bottlecaps, then step 350 is implemented, in which the current intensity of bottlecap(n) pixels is compared to the average intensity(n) of bottlecap(n) that was determined in step 264 before the game began. If these intensities differ by more than a small amount (such as 1 or 2 counts), then ambient light levels have changed enough to affect the game. This can be caused by shadows falling over target field 32, an added light directed at target field 32, or any other changes in the light level on bottlecap(n) that has occurred since the intensities were read and averaged in steps 296 and 298 of FIG. 12. If such a difference is present, then step 352 is implemented, in which the ring intensity threshold(n) is temporarily changed. Preferably, the ring intensity threshold is changed by the same amount as the difference found in step 350. For example, if the current intensity of bottlecap(n) is found to be 10 counts less than the average intensity(n), then the ring intensity threshold(n) is decreased by 10. The ring intensity threshold(n) is preferably only altered temporarily for next step 354, i.e., when bottle(n) is examined again in a later image 271, the original ring threshold intensity(n) is used.

After step 352, or if the intensity of bottlecap(n) is not different from the average intensity(n) in step 350, step 354 is implemented. In step 354, a ring mask is compared to the image 271 at the location of bottlecap(n) to determine if a ring is in a scoring position, i.e., over bottle(n). This step is described in greater detail with respect to FIG. 15 and is similar to step 294 of FIG. 12.

In alternate embodiments, if microprocessor 220 determines that a ring has landed on bottle(n) in step 354, then the processor 220 can check if a special scoring condition has occurred that warrants an adjustment in game score or game play. For example, the detected ring might be a special playing piece (has special dimensions, brightness, color, shape, etc.); or bottle(n) (or target(n)) might be a special target (which can be known by microprocessor 220 beforehand, or a special characteristic of bottlecap(n) can be detected to verify this condition).

Once it is determined if a ring is over bottle(n) in step 354, the process returns to step 348 to increment n and implement the process of FIG. 14 for the next bottle. Once all bottles have been examined, the process is complete as indicated at 356. Microprocessor 220 thus only examines bottles 38 in target field 32, and does not examine any rings 40 that are not centered on the bottles.

In an alternate embodiment, the ambient light of current image 271 examined in the steps of FIG. 14 can additionally be compared to an original image 271 recorded and stored in calibration step 264 for validation of light levels. A small light level change compensation is described with respect to step 350 of FIG. 14. However, for large light level changes (e.g., +/−50% change in light level, etc.), other procedures can be implemented. For example, one or more pixels describing comb 48 can be compared in intensity between the original and current images. If the intensity difference is greater than a predetermined threshold, then ambient light levels have changed greatly during the course of the game and could cause inaccurate results. Such large light changes can be due to turning on lights, shadows, blocking sunlight through windows, shining a light directly onto sensing apparatus 36, etc. If such a large light change is detected, then the microprocessor can take several actions. One action would be to simply invalidate the game and change the player's score to zero; an error message can also be displayed for the operator of game apparatus 10 to indicate the significant light level changes.

Figure 15:
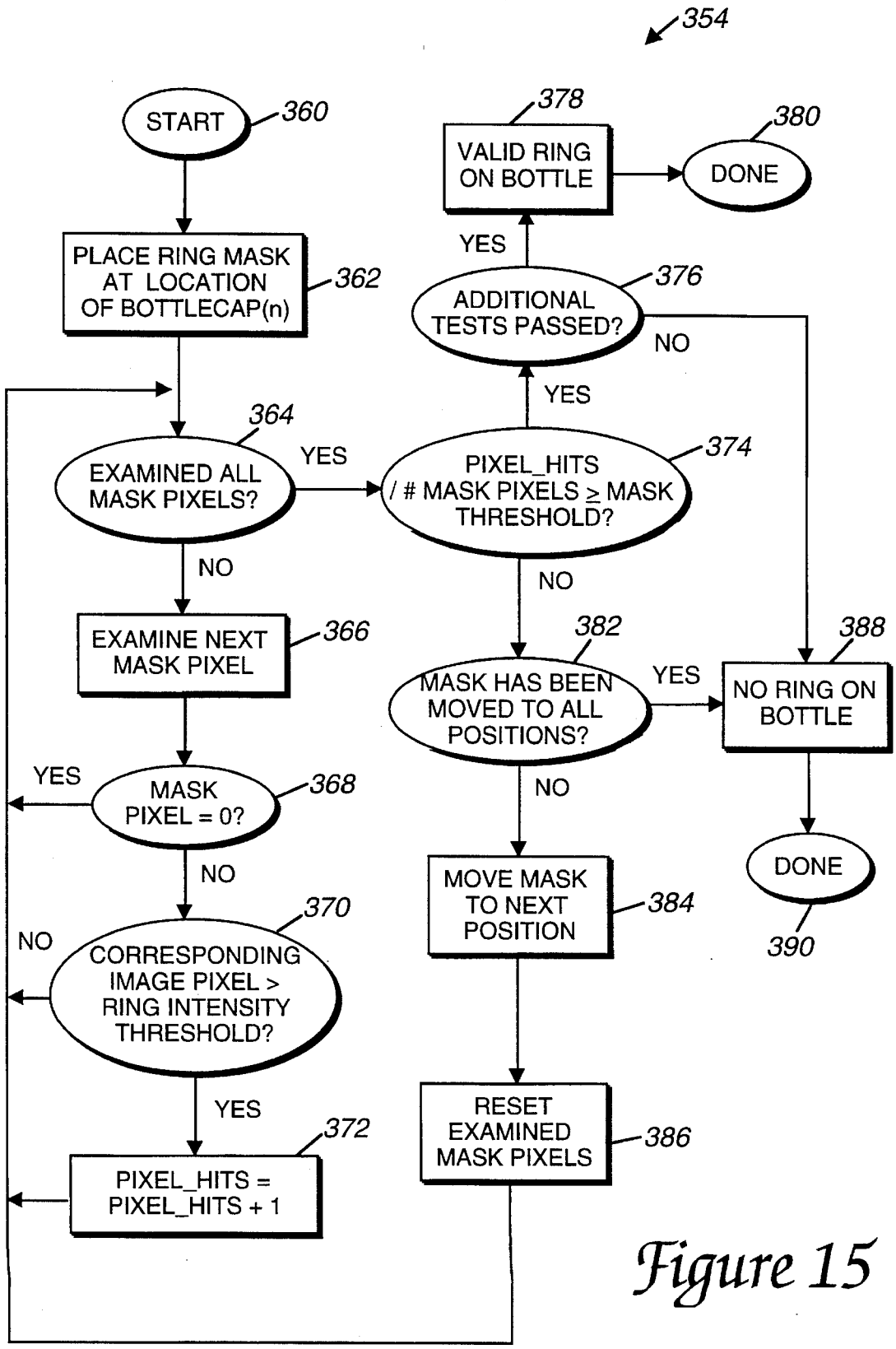
FIG. 15 is a flow diagram illustrating the step of FIG. 14 of comparing a ring mask to a portion of the recorded image to locate rings.

FIG. 15 is a flow diagram illustrating step 354 of FIG. 14, in which the ring mask is compared to a portion of image 271 to determine if a ring is over bottle(n). The process begins at 360, and, in a step 362, a ring mask is placed "over" the image 271 at the location of the center of bottlecap(n). The ring mask is similar to the bottlecap mask 293 described above. A ring mask is a predefined rectangular map of pixels stored in memory that describe a ring playing piece 40 (the mask can describe other shapes of playing pieces in other embodiments). See, for example, ring mask 301 as shown in FIG. 11. The ring pixels 303 are "on" and describe a ring as it should appear when over a bottle 38. Dark pixels 305 have a zero value and describe areas within the interior of a ring (dark pixels 305*a*) and outside the ring (dark pixels 305*b*).

The ring mask is placed at the location of bottlecap(n) on image 271. However, in the described embodiment, the bottles 38 appear slightly distorted through the lens of sensing apparatus 36, as shown in FIG. 11. Therefore, each bottle 38 of image 271 has an (x,y) offset associated with it and stored in program memory 222. This offset tells microprocessor 220 where to place ring mask 301 offset from the center of bottlecap(n) to achieve valid results. These offsets, for example, can be determined by testing at what location the ring mask yields a preferred mask percentage (i.e., percentage over the mask threshold) when the ring mask is placed over a valid ring and bottle image. Such offsets can be omitted in other embodiments which do not have distortion in image 271. In step 362, the variable PIXEL_HITS is also initialized to zero.

Steps 364 to 372 are similar to equivalent steps 312 to 320 of FIG. 13. In step 364, the microprocessor 220 checks if the examined mask pixel is equal to 0, i.e., if the pixel is a dark pixel 305*a* or 305*b* of mask 301 as shown in FIG. 11. If so, then the process returns to step 312 to check for the next pixel. If not, then step 318 is implemented, in which the image pixel of image 271 that corresponds to the current mask pixel is checked if it is greater than or equal to the ring intensity threshold(n). As above, in alternate embodiments, a check can be made in this step for color intensity brightness or other characteristic of the image pixels, etc. If the corresponding image pixel intensity is less than the intensity threshold(n), then the process returns to step 312 to check the next pixel of the mask. If the image pixel intensity is greater than or equal to the ring intensity threshold(n), then step 320 is implemented, in which PIXEL_HITS is incremented. The process then returns to step 312 to check for the next pixel of the mask.

If microprocessor 220 determines in step 364 that all ring mask pixels have been examined, then step 374 is implemented, in which the microprocessor divides PIXEL_HITS by the number of pixels in the ring mask. This result is the "mask percentage", the percentage of image pixels in the mask area that have a playing piece pixel intensity. The mask percentage is compared to the mask threshold. If the mask percentage is greater than or equal to the mask threshold, then, in step 376, additional tests are preferably made to validate that the ring is a valid playing piece. These additional tests are described in greater detail with reference to FIG. 16. If the additional tests are passed, then a valid ring is determined to be on bottle(n), as indicated in step 378, and the process is complete at 380. If the additional tests are failed, then no ring is determined to be over bottle(n) as indicated in step 388, and the process is complete at 390.

If the mask percentage is less than the mask threshold in step 376, then no ring has yet been detected; this is a "failure" result. In next step 382, the microprocessor checks if the mask has been moved to all designated positions. Similar to bottlecap mask 293 as described in step 330 of FIG. 12, ring mask 301 has a predetermined number of positions that it is to be moved to if a failure results from step 376. If the ring mask has been not been moved to all of these positions, then step 382 is implemented, in which the mask is moved to the next position. In the described embodiment, ring mask 301 has nine positions, similar to the mask positions of bottlecap mask 293. The nine positions are in one pixel increments about the center of bottlecap(n), so that a 3×3 pixel area is eventually covered (if failures keep resulting at step 374). In alternate embodiments, the mask can be moved greater distances and/or in more positions. After the mask has been moved to the next position in step 330, step 332 is implemented, in which the examined mask pixels are reset to zero for step 364, and the process then returns to step 364.

If the mask has been moved to all predetermined positions in step 382, then step 388 is implemented, in which no ring is determined to be over bottle(n). The process is then complete as indicated at 390.

Often, in situations where the mask percentage is under but close to the mask threshold, a ring may be positioned to the side of the bottle, such as ring 40*f* in FIG. 11; or noise or extra light may be influencing the pixel intensities.

When detecting a playing piece, the above-described process validates both that a ring is over a bottle and also that the ring is the correct size and shape (and is thus a dispensed playing piece, not a false one). The mask shows a ring or other playing piece in the correct dimensions as viewed by sensing apparatus 36. In addition, the additional tests of step 376 validate a ring's shape.

Other methods of detecting a ring in a scoring position can be used in alternate embodiments. For example, the microprocessor can look at four pixels spaced 90 degrees apart and located a certain distance from the center of bottlecap(n). If these four pixels have the desired playing piece intensity (i.e.., have an intensity above the ring intensity threshold(n)), then further analysis can be done according to the process 294 as described above. If the four pixels are not playing piece pixels, it can be assumed that no ring is around that bottle 38.

In a different embodiment, different types of rings 40 (or other playing pieces) can be used. Rings with different attributes or characteristics can be worth different amounts of points. For example, a smaller ring might be worth more points than a larger ring if it lands on a bottle 38. Or, green rings might be worth more than red rings. If different types of playing pieces are used, the microprocessor can validate an object for each type of playing piece. Thus, if two sizes of rings are used, the microprocessor 220 examines an object to determine if it is a large ring or a small ring in validation step 272 of FIG. 10. The microprocessor also can compare pixels around each bottle to two types of ring pixel masks in step 354 of FIG. 14: a small ring mask and a large ring mask.

The process of FIGS. 10–16 can be implemented using different types of playing pieces. For example, if coins are being used as playing pieces, a coin mask can be provided to detect coins on a target field. Also, if bottles 38 are not being used as targets in some embodiments, then a different reference point other than bottlecaps 267 can be used. For example, specific shapes can be positioned at the center of containers or other targets to provide a reference point to detect playing pieces like bottlecaps 267.

Figure 16:
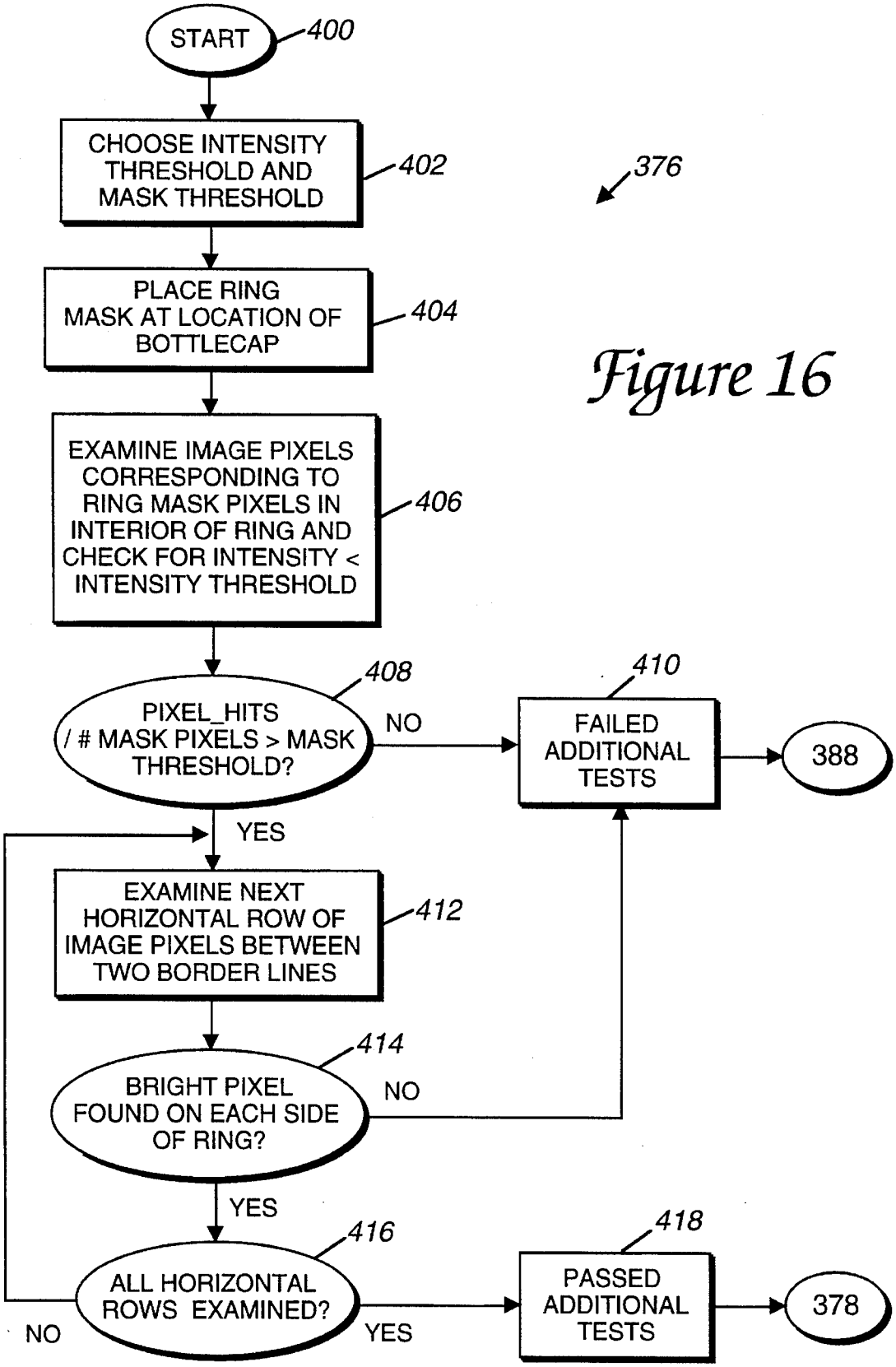
FIG. 16 is a flow diagram illustrating the step of FIG. 15 of performing additional tests to validate a ring on a bottle.

FIG. 16 is a flow diagram illustrating step 376 of FIG. 15, in which additional tests are applied to the ring detected over bottle(n) to verify that it is a valid ring playing piece. The process begins in step 400, and, in step 402, an intensity threshold and mask threshold are chosen. In the described embodiment, a predetermined number, such as 20, is added to ring intensity threshold(n) and the mask threshold is set to a low number such as 20%. In next step 404, the ring mask is placed at the location of bottlecap(n) (the original position at the center of bottlecap(n) plus any offset). In next step 406, the image pixels under the mask are again compared to the ring intensity threshold, similar to steps 364 to 372 of FIG. 15. This time, however, only image pixels corresponding to the center dark pixels 305*a* of ring mask 301 are compared to the intensity threshold, e.g. the pixels 327 between ring 40*h*. If they are under the intensity threshold(n), then PIXEL_HITS is incremented. In step 408, the mask percentage is compared to the mask threshold, similar to step 374 of FIG. 15. If the mask percentage is less than the mask threshold, then not enough image pixels under the ring mask have a dark enough intensity, and failure is indicated in step 410. The process then continues to step 388 of FIG. 15. Thus, if a certain percentage of pixels in the interior of the detected ring are not dark enough, the ring is not validated. This test rejects solid objects, such as a piece of paper, disc, or sphere, that may fall into target area 32 and pass earlier ring detection tests. The mask percentage is set to a low value because high intensity bottlecap 267 pixels are included in the interior of the ring and are also checked.

If the mask percentage is greater than or equal to the mask threshold in step 408, then the detected ring has passed the first test. In the first step 412 of the second test, the microprocessor examines the next horizontal row of image pixels between two border lines positioned on the ring. For example, as shown in image 271 of FIG. 11, ring 40*g* is shown over a bottle. Lines 413 are positioned tangent to the top and bottom of the image of bottle 38. Microprocessor 220 scans a horizontal row of pixels between the two lines 431, starting at the topmost row.

In step 414, the microprocessor checks if a bright pixel is present on both sides of the ring. For example, as shown by ring 40*g* of FIG. 11, pixels 415 on the outer and interior edges of the ring have a darker value due to the curvature of the ring's surface and the shadows caused by ambient light. Pixels 417 at the highest point of curvature have the brightest value since that area reflects the most light. As the microprocessor scans from left to right on a horizontal row of pixels, the pixel intensities will change from a darker value on the left edge of the ring to a bright value at pixel 417, to a dark value at 415. These intensities are repeated on the right side of the ring at 419. Thus, two very high pixel intensities should be detected by the microprocessor as it scans horizontally. If a bright pixel is not found on both sides of the ring, then the ring has failed the additional tests as indicated at step 410 and the process continues to step 388 of FIG. 15.

If the microprocessor does find two bright pixels on either side of the ring in step 414, then, in step 416, it is checked if all the horizontal rows have been examined. If not, then the process returns to step 412 to scan the next horizontal row of pixels just under the previously-scanned row. If bright pixels are not found in approximately the same horizontal position (x coordinate the same), then step 410 is implemented. If all horizontal rows have been examined and have passed the check of step 414, then the ring has passed the additional tests as indicated in step 418 and the process continues to step 378 of FIG. 15.

Additional tests can be implemented similarly to the above steps if further validation of the ring is needed. When validating different types of playing pieces, similar surface features can be detected, such as surface curvatures, markings, or other characteristics.

Figure 17:
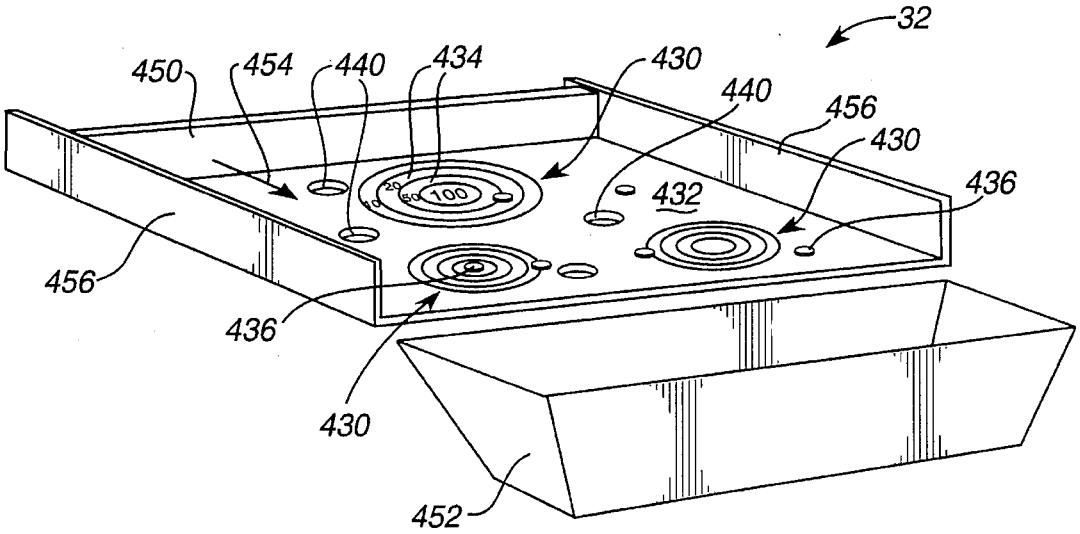
FIG. 17 is a perspective view of a portion of a target field for an alternate embodiment of the present invention.

FIG. 17 is an alternate embodiment of target field 32' in a game apparatus that provides coins, tokens, or similar disc-shaped playing pieces to be thrown by a player at targets provided in field 32'. Target field 32' can include target areas 430 that can be painted or similarly applied to the surface of base 432. Target areas can include scoring rings 434, where each scoring ring is assigned a different game score. If a playing piece such as coin 436 comes to rest within a ring 434, that ring's score is added to the game score. Target field 32' can also include apertures 440. If a coin 436 falls into an aperture 440, it is guided to a collection box underneath target field 32' and is removed from play. Other obstacles can also be added to target field 32' as desired. For example, a contoured surface, three-dimensional objects, receptacles, etc. can be provided to influence the path of a thrown coin or to be a target for a coin. In an alternate embodiment, plates, dishes, or similar receptacles can be placed on target field 32', similar to popular carnival games.

Coins 436 that have come to rest in target field 32' are analyzed by sensing apparatus 36 similarly to the embodiment described with reference to FIGS. 1–16 above. Sensing apparatus 36 records images of target field 32' and provides the image to the microprocessor 220, which analyzes the image for playing pieces. A coin can be analyzed in flight similarly to the rings described above. As with rings, pixels describing coins on the target field will have a different intensity than the pixels describing the background target field. The whole target field can be scanned for coins and the game score adjusted accordingly. For example, coins in scoring rings 434 increase the score by the ring value, coins in target field 32' that are not in a target area 430 increase the score by a lower amount, and rings that have fallen into apertures 440 do not increase the score at all.

Validation for coin playing pieces can be a more important and difficult task than validating rings or other large playing pieces. If actual monetary currency is being used as playing pieces, it becomes necessary to validate the coins to determine if the player is throwing either counterfeit or undervalued currency. For example, if only quarters are supposed to be used as playing pieces, it is necessary to determine the type of coins the player is throwing so that, for example, thrown nickels will not increase the game score. The image enhancement methods described above with reference to FIG. 10 should be used to increase the resolution of image 271 so that microprocessor 220 can determine if the thrown coins are the right size and have the correct markings on them. The microprocessor can compare images of coins 436 to pixel masks as described above. The pixel masks can include markings so that markings on the coin can also be compared. For example, a mask with markings can be rotated to several positions to determine if any of the rotated positions match a coin's markings.

Figure 17A:
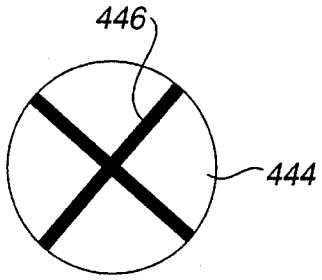
FIG. 17*a* is a diagrammatic illustration of game coin playing piece suitable for use with the embodiment of FIG. 17.

In a preferred embodiment, a player deposits a coin into coin slot 24 of front panel 16*a* and receives marked game coin playing pieces to use in the game. For example, as shown in FIG. 17*a*, a marked coin playing piece 444 is shaped approximately like a coin and can be dispensed to the player from dispenser 22. A mark 446 is provided on both sides of the playing piece 444. Mark 446 can be easily identified by microprocessor 220 when analyzing an image portraying playing pieces 444. In other embodiments, other types of playing pieces can be used. For example, balls having markings similar to playing piece 444 can be dispensed to the player.

In an alternate embodiment, a player can be allowed to throw any type of currency. Microprocessor 220 analyzes the types of coins in the recorded image of the target field 32' and increases game score according to both the type of coin and the area of field 32' where the coin came to rest. For example, a penny can increase the game score by a small amount, while a quarter can increase the score by a larger amount when positioned in the same area of target field 32' as the penny.

Once the game score has been increased, coins 356 are preferably moved off of target field 32'. This can be accomplished in several ways. The target field can be tilted, similarly to comb 48 of the above-described embodiment, to allow the coins to slide into a collection area or dispenser. Or, as shown in FIG. 17, a sweep arm 450 can be provided to move across the target field and force the coins into a collecting receptacle, such as funnel 452. Sweep arm 450 can, for example, move in the direction of arrow 454 by sliding along support rails 456.

In an alternate embodiment, coins 436 can be collected and examined in a different area than target field 32'. For example, if a player tosses coins into apertures having game score values, the coins can be collected below or behind the target field and validated at that time.

While this invention has been described in terms of several preferred embodiments, it is contemplated that alterations, modifications and permutations thereof will become apparent to those skilled in the art upon a reading of the specification and study of the drawings. For example, a wide variety of games can be used with the object sensing method and apparatus of the present invention. Games in which different types, sizes, shapes, colors, etc. of objects or playing pieces are thrown into or at different types of targets are all suitable for use with the sensor described herein. In addition, other types of comb lifting mechanisms, releasing mechanisms, and dispensers can be used to suit particular applications. Similarly, different control system components can be used to control a game apparatus of the present invention. It is therefore intended that the following claims include all such alterations, modifications and permutations as fall within the spirit and scope of the present invention.

What is claimed is:

1. A game apparatus comprising:

a sensor for validating a moving playing piece for said game apparatus, said playing piece being directed by a player, wherein said validation determines whether said playing piece is appropriate for use with said game apparatus or whether said playing piece is a false playing piece;

a target field for receiving said moving playing piece, wherein said sensor determines a final position of said moving playing piece at rest after said playing piece is engaged with said target field; and a scoring mechanism coupled to said sensor and operative to provide a game score based on said validation of said playing piece and said final position of said playing piece engaged with said target field.

2. A game apparatus as recited in claim 1 wherein said sensor includes a visual sensor for validating and determining a final position of said moving playing piece by detecting visible light.

3. A game apparatus as recited in claim 2 wherein said sensor includes a digital processor for determining and analyzing said final position of said playing piece and relaying said final position to said scoring mechanism.

4. A game apparatus as recited in claim 3 wherein said sensor includes a video camera and charge coupled device coupled to said video camera for detecting and recording an image of said moving playing piece and for recording an image of said final position of said playing piece.

5. A game apparatus as recited in claim 3 wherein said digital processor and said sensor analyze the identity of said moving playing piece to determine when said playing piece is valid for said game apparatus.

6. A game apparatus as recited in claim 3 wherein said digital processor and said sensor analyze a trajectory of said moving playing piece to determine when said playing piece is valid for said game apparatus.

7. A game apparatus as recited in claim 6 wherein said scoring mechanism provides said game score only when an identity of said playing piece and said trajectory of said playing piece are valid.

8. A game apparatus as recited in claim 3 wherein said target includes a target field including a plurality of individual targets, and wherein said scoring mechanism provides a game score when said playing piece engages an individual target.

9. A game apparatus as recited in claim 8 wherein said plurality of individual targets include a plurality of cylindrical objects extending perpendicularly from said playing field, wherein said playing piece is a ring, and wherein said game score is increased when said ring has a final position such that one of said cylindrical objects extends through a center of said ring.

10. A game apparatus as recited in claim 9 further comprising a return mechanism for providing said playing piece to said player after said playing piece has been directed by said player to said target.

11. A game apparatus as recited in claim 10 wherein said game apparatus is controlled by a digital computer.

12. A game apparatus comprising:

a target field;

a sensor for detecting a playing piece directed by a player, said sensor detecting an identity of said playing piece and a final resting position of said playing piece on said target, said identity being used to determine whether said playing piece is valid for said game apparatus or whether said playing piece is a false playing piece; and a scoring mechanism coupled to said sensor for increasing a game score based on said identity and said final resting position of said playing piece, wherein said scoring mechanism does not increase said game score when said identity of said playing piece is not valid.

13. A game apparatus as recited in claim 12 wherein said target field includes a plurality of targets, wherein said playing piece can engage any one of said plurality of targets.

14. A game apparatus as recited in claim 13 wherein said sensor includes a video camera that can record an image of said target field and a digital processor for processing and analyzing said image of said target field.

15. A game apparatus as recited in claim 14 wherein said digital processor examines a portion of said image of said target field corresponding to a predetermined mask image to determine said identity of said playing piece and said final position of said playing piece.

16. A game apparatus as recited in claim 15 wherein said sensor detects a size of said directed playing piece to detect said identity of said playing piece.

17. A game apparatus as recited in claim 16 wherein said sensor further detects a trajectory of said directed playing piece to determine when said playing piece is a valid playing piece for said game apparatus.

18. A game apparatus as recited in claim 16 wherein said scoring mechanism increases a game score value when said directed playing piece has a final resting position engaged with one of said plurality of targets.

19. A game apparatus as recited in claim 12 further comprising a return mechanism for returning said playing piece to a playing piece dispenser.

20. A game apparatus as recited in claim 19 wherein said return mechanism includes a mechanism for tilting said target field such that said playing piece moves off said target field into a playing piece collector, said mechanism for tilting being coupled to said target field.

21. A game apparatus as recited in claim 20 wherein said return mechanism includes a playing piece collector mechanism, said playing piece collector mechanism including an apparatus for moving a playing piece to a playing piece dispenser and a sensor for detecting when said playing piece has been moved.

22. A game apparatus as recited in claim 21 wherein said apparatus for moving a playing piece to a playing piece dispenser includes a turntable driven by a motor.

23. A game apparatus as recited in claim 16 further comprising an award dispenser for dispensing an award to a player based on said game score.

24. A game apparatus as recited in claim 23 wherein said playing piece is a circular ring.

25. A game apparatus as recited in claim 23 wherein said playing piece is a coin.

26. A game apparatus as recited in claim 23 wherein said playing piece is a ball.

27. A method for playing a game having an object sensor, the method comprising the steps of:

(a) providing a playing piece to a player;

(b) providing a target in a target field at which to direct said playing piece;

(c) sensing a final resting position of said playing piece in relation to said target, wherein said final resting position is sensed by comparing a region of said target field around said target to a predetermined image;

(d) providing a game score based upon said final resting position of said playing piece.

28. A method as recited in claim 27 wherein said step of providing a target includes providing a target field having a plurality of individual targets.

29. A method for playing a game comprising the steps of:

providing a target field for receiving a moving playing piece directed by a player;

detecting a final rest position of said moving playing piece with respect to said target field;

validating an identity of said playing piece so that said playing piece is determined either as a valid playing piece for said game or as a false playing piece; and providing a score based on said final rest position of said playing piece when said playing piece is determined as a valid playing piece.

30. A method as recited in claim 29 wherein said step of determining a final position of said moving playing piece includes recording an image of said target field and examining said image to determine said final position and validate said identity of said playing piece.

31. A method as recited in claim 30 wherein said target field includes a plurality of targets engagable by said playing piece, and wherein said step of examining said images includes examining said plurality of targets in said image to determine if said playing piece is engaged with one of said targets.

32. A method as recited in claim 31 wherein said step of examining said image includes accurately detecting the positions of said targets by comparing said images of said targets with a predetermined image of said target.

33. A method as recited in claim 32 further comprising a step of determining when said playing piece is in a scoring position relative to said target by comparing said images of said targets with a predetermined image of said playing piece.

34. A method as recited in claim 33 wherein said predetermined image of said target and said predetermined image of said playing piece are pixel maps stored in memory.

35. A method as recited in claim 33 wherein said step of providing a game score includes providing a game score when at least a portion of an image of a target in said recorded image has an intensity greater than or equal to a playing piece intensity threshold.

36. A method as recited in claim 34 wherein said step of providing a game score includes providing a game score when an image of a target in said recorded image corresponds to said predetermined image of said playing piece within a threshold percentage.

37. A method as recited in claim 29 wherein said step of validating said identity of said playing piece includes recording a plurality of images of said target field and examining said images of said moving playing piece to determine a trajectory of said playing piece.

38. A method as recited in claim 33 wherein said step of examining said image includes utilizing an image enhancing process to provide said image in a higher resolution.

39. A method as recited in claim 33 further comprising a step of determining when an ambient light around said target field changes, and compensating said step of determining a final position for said changed ambient light.

40. A method for sensing an object with respect to a target, the method comprising the steps of:

providing a target at which a moving object is directed;

periodically recording an image of said target;

determining that said moving object has either engaged or has not engaged said target by examining a recorded image of said target; and validating an identity of said object by examining said recorded image of said target.

41. A method as recited in claim 40 wherein said step of determining when said moving object has engaged said target includes comparing said recorded image of said target with a predetermined image of said object.

42. A method as recited in claim 41 wherein said recorded image includes a plurality of pixels, and wherein said predetermined image of said object is a mask pixel map stored in memory.

43. A method as recited in claim 42 wherein said step of comparing said recorded image of said target with a predetermined image of said object includes placing said mask pixel map over a portion of said recorded image and determining when said portion of said recorded image includes pixels corresponding to selected pixels of said mask pixel map.

44. A method as recited in claim 43 wherein when said portion of said recorded image includes a number of pixels corresponding to said selected pixels of said mask pixel map greater than or equal to a mask percentage threshold, said object is determined to be engaged with said target.

45. A method as recited in claim 44 wherein said pixels of said recorded image have an intensity, and wherein when said pixels of said portion of said recorded image that correspond to said selected pixels of said mask pixel map have an intensity greater than or equal to an intensity threshold, said object is determined to be engaged with said target.

46. A method as recited in claim 44 further comprising placing said mask pixel map at a different location when said object is not determined to engage said target.

47. A method as recited in claim 44 further comprising examining said recorded images of said moving object to determine a valid identity and trajectory of said object.

48. A method as recited in claim 46 further comprising a step of providing a plurality of targets.

49. A game apparatus comprising:

(a) a sensor for validating a moving playing piece for said game apparatus, said playing piece being directed by a player, said sensor including:

(i) a visual sensor for validating and determining a final position of said moving playing piece by detecting visible light;

(ii) a digital processor for determining and analyzing said final position of said playing piece; and (iii) a video camera and a charge coupled device coupled to said video camera for detecting and recording an image of said moving playing piece and for recording an image of said final position of said playing piece;

(b) a target field for receiving said moving playing piece, wherein said sensor determines a final position of said moving playing piece at rest after said playing piece is engaged with said target field; and (c) a scoring mechanism coupled to said sensor and operative to provide a game score based on said validation of said playing piece and said final position of said playing piece engaged with said target field, said digital processor relaying said final position to said scoring mechanism.

50. A game apparatus as recited in claim 49 wherein said digital processor and said sensor analyze the identity of said moving playing piece to determine when said playing piece is valid for said game apparatus.

51. A game apparatus as recited in claim 49 wherein said digital processor and said sensor analyze a trajectory of said moving playing piece to determine when said playing piece is valid for said game apparatus.

52. A game apparatus as recited in claim 51 wherein said scoring mechanism provides said game score only when an identity of said playing piece and said trajectory of said playing piece are valid.

53. A game apparatus as recited in claim 49 wherein said target includes a target field including a plurality of individual targets, and wherein said scoring mechanism provides a game score when said playing piece engages an individual target.

54. A game apparatus comprising:

(a) a sensor for validating a moving ring for said game apparatus, said ring being directed by a player, said sensor including:

(i) a visual sensor for validating and determining a final position of said moving ring by detecting visible light; and (ii) a digital processor for determining and analyzing said final position of said ring;

(b) a target field for receiving said moving ring, wherein said sensor determines a final position of said moving ring at rest after said ring is engaged with said target field, said target field including a plurality of individual targets, said individual targets including a plurality of cylindrical objects extending perpendicularly from said playing field; and (c) a scoring mechanism coupled to said sensor and operative to provide a game score based on said validation of said ring and said final position of said ring engaged with an individual target, wherein said game score is increased when said ring has a final position such that one of said cylindrical objects extends through a center of said ring, said digital processor relaying said final position to said scoring mechanism.

55. A game apparatus as recited in claim 54 wherein said digital processor and said sensor analyze the identity of said moving ring to determine when said ring is valid for said game apparatus.

56. A game apparatus as recited in claim 55 wherein said scoring mechanism provides said game score only when an identity of said playing piece and said trajectory of said playing piece are valid.

57. A game apparatus as recited in claim 54 further comprising a return mechanism for providing said ring to said player after said ring has been directed by said player to said target.

58. A game apparatus as recited in claim 57 wherein said game apparatus is controlled by a digital computer.

59. A game apparatus as recited in claim 54 wherein said sensor includes a video camera and charge coupled device coupled to said video camera for detecting and recording an image of said moving playing piece and for recording an image of said final position of said playing piece.

60. A game apparatus comprising:

a target field including a plurality of targets;

a sensor for detecting a playing piece directed by a player, said sensor including a video camera that can record an image of said target field and a digital processor for processing and analyzing said image of said target field, said sensor detecting an identity of said playing piece and a final resting position of said playing piece on said target field, wherein said playing piece can engage any one of said plurality of targets; and a scoring mechanism coupled to said sensor for increasing a game score based on said identity and said final resting position of said playing piece, wherein said scoring mechanism does not increase said game score when said identity of said playing piece is not valid.

61. A game apparatus as recited in claim 60 wherein said digital processor examines a portion of said image of said target field corresponding to a predetermined mask image to determine said identity of said playing piece and said final position of said playing piece.

62. A game apparatus as recited in claim 61 wherein said sensor detects a size of said directed playing piece to detect said identity of said playing piece.

63. A game apparatus as recited in claim 62 wherein said sensor further detects a trajectory of said directed playing piece to determine when said playing piece is a valid playing piece for said game apparatus.

64. A game apparatus as recited in claim 62 wherein said scoring mechanism increases a game score value when said directed playing piece has a final resting position engaged with one of said plurality of targets.

65. A game apparatus as recited in claim 62 further comprising an award dispenser for dispensing an award to a player based on said game score.

66. A game apparatus as recited in claim 65 wherein said playing piece is a circular ring.

67. A game apparatus as recited in claim 65 wherein said playing piece is a coin.

68. A game apparatus as recited in claim 65 wherein said playing piece is a ball.

69. A method for playing a game having an object sensor, the method comprising the steps of:

(a) providing a playing piece to a player;

(b) providing a plurality of individual targets in a target field at which to direct said playing piece;

(c) sensing a final resting position of said playing piece in relation to said target, wherein an image of said target field is recorded and said final resting position is sensed by comparing a region of said target field around said target in said recorded image to a predetermined image;

(d) providing a game score based upon said final resting position of said playing piece.

70. A method as recited in claim 69 wherein a portion of said image of said target field that corresponds to said region of said target field and to said predetermined image is examined to determine said final position of said playing piece.

71. A method as recited in claim 70 wherein said step of sensing a final resting position of said object includes detecting an intensity of said playing piece in said image of said target field, wherein said intensity of said playing piece is over a threshold intensity to be detected as a playing piece.

72. A method as recited in claim 71 wherein said playing piece is determined to be in a final position that provides a game score when said portion of said image of said target field that corresponds to said predetermined image is equal to said predetermined image within a threshold percentage and when said portion has an intensity over said threshold intensity.

73. A method as recited in claim 72 wherein said image of said target field is composed of pixels, and wherein said predetermined image is a mask pixel map.

74. A method as recited in claim 70 wherein said image of said target field is examined to determine an identity of said playing piece.

75. A method as recited in claim 69 further comprising step of detecting the identity of said playing piece as said playing piece is directed towards said target to determine when said playing piece is a valid playing piece for said game apparatus.

76. A method as recited in claim 75 further comprising a step of sensing a trajectory of said playing piece as said playing piece is directed towards said target and modifying said game score only when said trajectory of said playing piece is within predetermined spatial constraints.

77. A game apparatus as recited in claim 76 wherein said predetermined spatial constraints include a predetermined direction from which said playing piece was directed.

78. A method as recited in claim 77 wherein said step of sensing a final resting position of said playing piece in relation to said target includes sensing a final resting position of a circular ring in relation to a bottle.

79. A method for playing a game comprising the steps of:

providing a target field for receiving a moving playing piece directed by a player;

determining a final position of said moving playing piece with respect to said target field;

validating an identity of said playing piece, including recording an image of said target field and examining said image to determine said final position and validate said identity of said playing piece; and providing a score based on said final position of said playing piece and based on said identity of said playing piece.

80. A method as recited in claim 79 wherein said target field includes a plurality of targets engagable by said playing piece, and wherein said step of examining said images includes examining said plurality of targets in said image to determine if said playing piece is engaged with one of said targets.

81. A method as recited in claim 80 wherein said step of examining said image includes accurately detecting the positions of said targets by comparing said images of said targets with a predetermined image of said target.

82. A method as recited in claim 81 further comprising a step of determining when said playing piece is in a scoring position relative to said target by comparing said images of said targets with a predetermined image of said playing piece.

83. A method as recited in claim 82 wherein said predetermined image of said target and said predetermined image of said playing piece are pixel maps stored in memory.

84. A method as recited in claim 82 wherein said step of providing a game score includes providing a game score when at least a portion of an image of a target in said recorded image has an intensity greater than or equal to a playing piece intensity threshold.

85. A method as recited in claim 83 wherein said step of providing a game score includes providing a game score when an image of a target in said recorded image corresponds to said predetermined image of said playing piece within a threshold percentage.

86. A method as recited in claim 79 wherein said step of validating said identity of said playing piece includes recording a plurality of images of said target field and examining said images of said moving playing piece to determine a trajectory of said playing piece.

87. A method as recited in claim 82 wherein said step of examining said image includes utilizing an image enhancing process to provide said image in a higher resolution.

88. A method as recited in claim 82 further comprising a step of determining when an ambient light around said target field changes, and compensating said step of determining a final position for said changed ambient light.

89. A method for playing a game having an object sensor, the method comprising the steps of:

(a) providing a target in a target field at which a player is to direct a playing piece;

(b) recording an image of said target field;

(c) examining a portion of said recorded image that corresponds to a region of said target field that includes said target and corresponds to a predetermined image stored in memory;

(c) determining a final resting position of said playing piece in relation to said target by comparing said portion of said recorded image to said predetermined image;

(d) providing a game score based upon said final resting position of said playing piece when said portion of said recorded image is equal to said predetermined image within a threshold percentage.

* * * * *